US010070688B2

(12) United States Patent
Lawless

(10) Patent No.: US 10,070,688 B2
(45) Date of Patent: Sep. 11, 2018

(54) SOLE STRUCTURES WITH REGIONALLY APPLIED AUXETIC OPENINGS AND SIPING

(71) Applicant: NIKE, Inc., Beaverton, OR (US)

(72) Inventor: Deborah L. Lawless, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 148 days.

(21) Appl. No.: 14/826,936

(22) Filed: Aug. 14, 2015

(65) Prior Publication Data

US 2017/0042285 A1 Feb. 16, 2017

(51) Int. Cl.

| | |
|---|---|
| ***A43B 3/00*** | (2006.01) |
| ***A43B 13/18*** | (2006.01) |
| ***A43B 13/22*** | (2006.01) |
| ***A43B 13/42*** | (2006.01) |
| ***A43B 13/12*** | (2006.01) |
| ***A43B 13/14*** | (2006.01) |

(52) U.S. Cl.

CPC ..... *A43B 13/181* (2013.01); *A43B 3/0073* (2013.01); *A43B 13/122* (2013.01); *A43B 13/14* (2013.01); *A43B 13/184* (2013.01); *A43B 13/186* (2013.01); *A43B 13/187* (2013.01); *A43B 13/223* (2013.01); *A43B 13/42* (2013.01)

(58) Field of Classification Search

CPC ... A43B 3/0073; A43B 13/122; A43B 13/141; A43B 13/181; A43B 13/184; A43B 13/186; A43B 13/223

USPC ..... 36/25 R, 28, 31

See application file for complete search history.

(56) References Cited

U.S. PATENT DOCUMENTS

| | | | |
|---|---|---|---|
| 503,062 | A | 8/1893 | Norwood |
| 1,343,450 | A | 6/1920 | Haskell |
| 1,733,733 | A | 10/1929 | Hess |
| 2,211,509 | A | 8/1940 | Lumbard |
| 2,251,468 | A | 8/1941 | Smith |
| 2,363,995 | A | 11/1944 | Rollman et al. |
| 2,432,533 | A | 12/1947 | Margolin |
| 2,963,722 | A | 12/1960 | Stix |
| 3,626,532 | A | 12/1971 | Smith |
| 3,662,478 | A | 5/1972 | Schwab |
| 3,745,600 | A | 7/1973 | Rubico et al. |
| 3,757,436 | A | 9/1973 | Winkler et al. |
| 4,050,108 | A | 9/1977 | Londner |
| 4,272,850 | A | 6/1981 | Rule |
| 4,340,626 | A | 7/1982 | Rudy |
| 4,484,398 | A | 11/1984 | Goodwin et al. |

(Continued)

FOREIGN PATENT DOCUMENTS

| | | | |
|---|---|---|---|
| CN | 103082569 | A | 5/2013 |
| CN | 203279903 | U | 11/2013 |

(Continued)

OTHER PUBLICATIONS

International Search Report and Written Opinion dated Dec. 4, 2014 in PCT/US2014/052038.

(Continued)

*Primary Examiner* — Sharon M Prange
(74) *Attorney, Agent, or Firm* — Quinn IP Law

(57) ABSTRACT

A sole structure for an article of footwear can include auxetic openings and sipes. The auxetic openings and sipes may be applied in a regional manner to achieve different characteristics for the sole structure in the different regions.

9 Claims, 19 Drawing Sheets

(56) References Cited

U.S. PATENT DOCUMENTS 4,668,557 A 5/1987 Lakes
4,756,098 A 7/1988 Boggia
D302,352 S * 7/1989 Austin ..... D2/959
4,858,340 A 8/1989 Pasternak
4,899,412 A 2/1990 Ganon
4,967,492 A 11/1990 Rosen
4,999,931 A 3/1991 Vermeulen
5,012,597 A 5/1991 Thomasson
5,060,402 A 10/1991 Rosen
D339,459 S 9/1993 Yoshikawa et al.
D344,170 S 2/1994 Acoff
5,469,639 A 11/1995 Sessa
5,718,064 A 2/1998 Pyle
5,813,146 A 9/1998 Gutkowski et al.
5,918,338 A 7/1999 Wong
D413,714 S 9/1999 Challant
D420,786 S 2/2000 Ramer et al.
6,151,804 A 11/2000 Hieblinger
6,178,662 B1 1/2001 Legatzke
D437,106 S 2/2001 Cagner
6,226,896 B1 5/2001 Friton
D453,989 S 3/2002 Cagner
6,357,146 B1 3/2002 Wordsworth et al.
6,412,593 B1 7/2002 Jones
6,487,795 B1 12/2002 Ellis, III
6,564,476 B1 5/2003 Hernandez
6,574,889 B2 6/2003 Cagner
D487,614 S 3/2004 Le
D488,916 S 4/2004 McClaskie
6,862,820 B2 3/2005 Farys et al.
D531,788 S 11/2006 Rittberg
7,132,032 B2 11/2006 Tawney et al.
7,160,621 B2 1/2007 Chaudhari et al.
7,252,870 B2 8/2007 Anderson et al.
7,254,906 B2 8/2007 Morris et al.
7,287,343 B2 10/2007 Healy
7,310,894 B1 12/2007 Schwarzman et al.
D571,543 S 6/2008 Sungadi
7,455,567 B2 11/2008 Bentham et al.
7,487,602 B2 2/2009 Berger et al.
7,546,698 B2 6/2009 Meschter
7,574,818 B2 8/2009 Meschter
D614,382 S 4/2010 Grenet et al.
7,770,307 B2 8/2010 Meschter
7,814,852 B2 10/2010 Meschter
7,827,703 B2 11/2010 Geer et al.
7,870,681 B2 1/2011 Meschter
7,870,682 B2 1/2011 Meschter et al.
8,002,879 B2 8/2011 Hook
D653,844 S 2/2012 Smith
8,122,616 B2 2/2012 Meschter et al.
8,132,340 B2 3/2012 Meschter
8,146,272 B2 * 4/2012 Dukovic ..... A43B 13/141 36/103
8,186,078 B2 5/2012 Avar et al.
8,196,316 B2 6/2012 Cook et al.
8,220,072 B2 7/2012 Dodd
8,225,530 B2 7/2012 Sokolowski et al.
8,266,827 B2 9/2012 Dojan et al.
8,276,294 B2 10/2012 Polegato Moretti
8,277,719 B2 10/2012 Alderson et al.
8,312,645 B2 11/2012 Dojan et al.
8,322,050 B2 12/2012 Lubart
8,343,404 B2 1/2013 Meli et al.
8,388,791 B2 3/2013 Dojan et al.
8,490,299 B2 7/2013 Dua et al.
8,516,723 B2 8/2013 Ferrigan et al.
8,544,197 B2 10/2013 Spanks et al.
8,631,589 B2 1/2014 Dojan
8,661,564 B2 3/2014 Dodd
8,732,982 B2 5/2014 Sullivan et al.
D707,934 S 7/2014 Petrie
D716,027 S 10/2014 Kirschner
D717,034 S 11/2014 Bramani
8,961,733 B2 2/2015 Dodd
2004/0181972 A1 9/2004 Csorba
2006/0059717 A1 3/2006 Mitchell
2007/0213838 A1 9/2007 Hengelmolen
2007/0240333 A1 10/2007 Le et al.
2008/0011021 A1 1/2008 Starbuck et al.
2008/0216357 A1 9/2008 Fogg et al.
2008/0250673 A1 10/2008 Andrews et al.
2008/0289214 A1 11/2008 Aveni
2009/0064536 A1 3/2009 Klassen et al.
2009/0064540 A1 3/2009 Sokolowski et al.
2009/0119820 A1 5/2009 Bentham et al.
2009/0183392 A1 7/2009 Shane
2009/0276933 A1 11/2009 Dodd
2009/0293314 A1 * 12/2009 Dekovic ..... A43B 13/141 36/103
2009/0307932 A1 12/2009 Kirby et al.
2010/0029796 A1 2/2010 Alderson et al.
2010/0043255 A1 2/2010 Trevino
2010/0095551 A1 4/2010 Gupta et al.
2010/0126041 A1 5/2010 Francis
2010/0139122 A1 6/2010 Zanatta
2010/0170117 A1 7/2010 Kim
2010/0236098 A1 9/2010 Morgan
2011/0099845 A1 5/2011 Miller
2011/0119956 A1 5/2011 Borel et al.
2011/0168313 A1 7/2011 Ma et al.
2011/0247237 A1 10/2011 Jara et al.
2011/0247240 A1 10/2011 Eder et al.
2012/0021167 A1 1/2012 Plant
2012/0023686 A1 2/2012 Huffa et al.
2012/0117826 A1 5/2012 Jarvis
2012/0124861 A1 5/2012 Losani
2012/0124865 A1 5/2012 Opie et al.
2012/0129416 A1 5/2012 Anand et al.
2012/0159810 A1 6/2012 Klassen
2012/0174432 A1 7/2012 Peyton
2012/0181896 A1 7/2012 Kornbluh et al.
2012/0198720 A1 8/2012 Farris et al.
2012/0210607 A1 8/2012 Avar et al.
2012/0233878 A1 9/2012 Hazenberg et al.
2012/0233885 A1 * 9/2012 Shaffer ..... A43B 13/20 36/103
2012/0266492 A1 10/2012 Youngs et al.
2012/0272550 A1 11/2012 Parce
2012/0315456 A1 12/2012 Scarpa et al.
2013/0000152 A1 1/2013 Cooper et al.
2013/0071583 A1 3/2013 Evans et al.
2013/0081305 A1 4/2013 Byrne
2013/0104428 A1 5/2013 O'Brien et al.
2013/0152428 A1 6/2013 Bishop et al.
2013/0160324 A1 6/2013 Peyton et al.
2013/0160328 A1 6/2013 Hatfield et al.
2013/0219636 A1 8/2013 Dojan et al.
2013/0239444 A1 9/2013 Polegato Moretti
2013/0276333 A1 10/2013 Wawrousek et al.
2013/0284732 A1 10/2013 Van Schaftingen
2013/0340288 A1 12/2013 Baker et al.
2014/0053311 A1 2/2014 Nordstrom et al.
2014/0053312 A1 2/2014 Nordstrom et al.
2014/0059734 A1 3/2014 Toronjo
2014/0090271 A1 4/2014 Hoffer et al.
2014/0101816 A1 4/2014 Toronjo
2014/0157631 A1 6/2014 Dodd
2014/0165427 A1 6/2014 Molyneux et al.
2014/0173938 A1 6/2014 Beye et al.
2014/0205795 A1 * 7/2014 Hu ..... D04B 21/14 428/116
2014/0215853 A1 * 8/2014 Rushbrook ..... A43B 5/001 36/102
2014/0237850 A1 8/2014 Hull
2014/0260281 A1 9/2014 Innes
2015/0075033 A1 3/2015 Cross et al.

(56) References Cited

U.S. PATENT DOCUMENTS

| | | | |
|---|---|---|---|
| 2015/0075034 | A1 | 3/2015 | Cross et al. |
| 2015/0101215 | A1 | 4/2015 | Henderson et al. |

FOREIGN PATENT DOCUMENTS

| | | | |
|---|---|---|---|
| EP | 2702884 | A1 | 3/2014 |
| GB | 2 147 792 | A | 5/1985 |
| GB | 2 455 167 | A | 6/2009 |
| GB | 2 463 446 | A | 3/2010 |
| JP | H0385905 | U | 8/1991 |
| JP | 2005-143637 | A | 6/2005 |
| KR | 20120111841 | A | 10/2012 |
| WO | 03/022085 | A2 | 3/2003 |
| WO | 2007052054 | A1 | 5/2007 |
| WO | 2012171911 | A1 | 12/2012 |
| WO | 2015041796 | A1 | 3/2015 |

OTHER PUBLICATIONS

Office Action dated Mar. 26, 2015 in U.S. Appl. No. 14/030,002.
International Search Report and Written Opinion dated Oct. 14, 2015 in PCT/US2015/038958.
International Search Report and Written Opinion dated Nov. 17, 2015 in PCT/US2015/040523.
PCT International Search Report and Written Opinion, for International Application No. PCT/US2016/043923, dated Oct. 6, 2016.

* cited by examiner

SOLE STRUCTURES WITH REGIONALLY APPLIED AUXETIC OPENINGS AND SIPING

BACKGROUND

The present embodiments relate generally to articles of footwear, and in particular to articles of footwear with sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, a sole structure for an article of footwear includes a first region and a second region, the first region being disposed adjacent to the second region. The sole structure also includes a first set of openings arranged in an auxetic configuration, the first set of openings being disposed in the first region. The sole structure also includes a first set of sole portions bounding the first set of openings as well as a set of sipes disposed in the second region, where the set of sipes divides the second region into a second set of sole portions. Every sole portion in the first set of sole portions is continuously connected to at least one other sole portion in the first set of sole portions by a junction. Every sole portion in the second set of sole portions is separated from any adjacent sole portion by a sipe from the set of sipes.

In another aspect, a sole structure for an article of footwear includes a midsole component and an outer sole member disposed on an outer surface of the midsole component. The sole structure also includes a set of openings arranged in an auxetic configuration in the midsole component, the set of openings including a first opening with a first arm portion, a second arm portion and a third arm portion extending from a central portion of the opening. The outer sole member includes a slotted region including a slot separating a first finger portion and a second finger portion of the outer sole member and the first arm portion of the first opening extends into the slot.

In another aspect, a sole structure for an article of footwear includes a first region and a second region, the first region being disposed adjacent to the second region. The sole structure also includes a first set of sipes in the first region and a second set of sipes in the second region. The first region includes a first set of sole portions, where each sole portion is completely separated from each adjacent sole portion by the sipes in the first set of sipes. The second region includes a second set of sole portions, where each sole portion is completely separated from one adjacent sole portion by a sipe of the second set of sipes and where each sole portion is joined to at least one adjacent sole portion by a connecting portion. Each connecting portion is disposed between two co-linear sipes.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
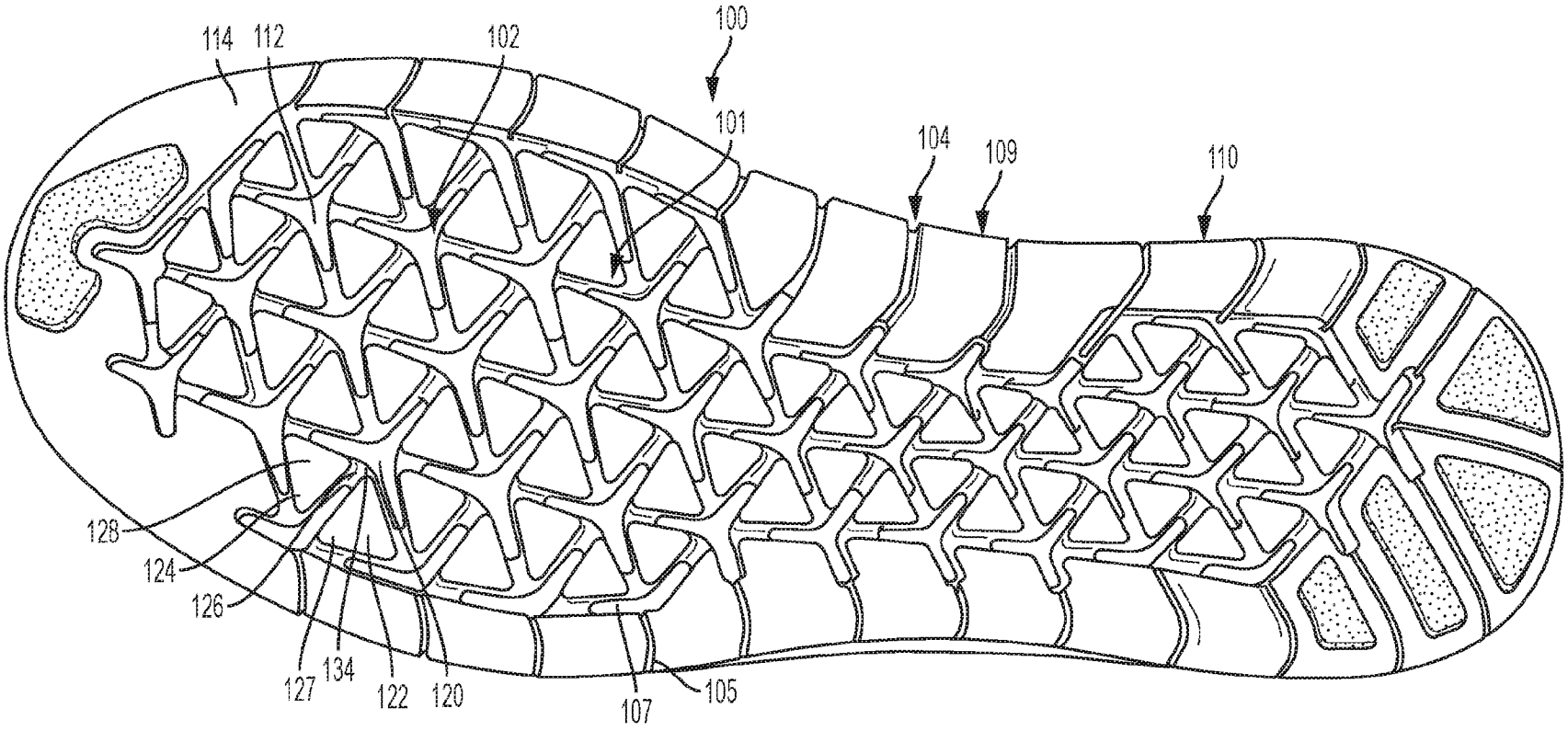
FIG. 1 is a schematic bottom view of an embodiment of a sole structure with auxetic openings.

FIGS. 1-19 include views of multiple embodiments of sole structures for use with various kinds of articles of footwear. In some embodiments, the sole structures shown in the figures may be part of an athletic shoe. More generally, in some embodiments the sole structures included in the figures could be incorporated into any kind of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for the various sole structures could be incorporated into various other kinds of non-sports related footwear, including, but not limited to, slippers, sandals, high-heeled footwear, and loafers.

For purposes of clarity, each embodiment includes a single sole structure for either a left or right article of footwear. However, it will be understood that other embodiments may incorporate a corresponding sole structure and/or article of footwear (e.g., a corresponding left or right shoe in a pair) that may share some, and possibly all, of the features of the various sole structures described herein and shown in the figures.

The embodiments may be characterized by various directional adjectives and reference portions. These directions and reference portions may facilitate in describing the portions of a sole structure and/or more generally an article of footwear, either of which may be referred to more generally as a component.

For consistency and convenience, directional adjectives are employed throughout this detailed description corresponding to the illustrated embodiments. The term "longitudinal" as used throughout this detailed description and in the claims refers to a direction oriented along a length of a component (e.g., a sole structure). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward. Additionally, the term "inner" refers to a portion of a component disposed closer to an interior of an article, or closer to a foot when the article is worn. Likewise, the term "outer" refers to a portion of a component disposed further from the interior of the article or from the foot. Thus, for example, the inner surface of a component is disposed closer to an interior of the article than the outer surface of the component. This detailed description makes use of these directional adjectives in describing an article and various components of a sole structure.

Each sole structure may be broadly characterized by a number of different regions or portions. For example, a sole structure could include a forefoot portion, a midfoot portion, and a heel portion. A forefoot region of a sole structure may be generally associated with the toes and joints connecting the metatarsals with the phalanges in the foot. A midfoot region may be generally associated with the arch of a foot. Likewise, a heel region may be generally associated with the heel of a foot, including the calcaneus bone. In addition, a sole structure may include a lateral side and a medial side. In particular, the lateral side and the medial side may be opposing sides of a sole structure. As used herein, the terms forefoot region, midfoot region, and heel region as well as the lateral side and medial side are not intended to demarcate precise areas of a sole structure. Rather, these regions and sides are intended to represent general areas of the sole structure that provide a frame of reference during the following discussion.

Some of the embodiments in the figures include portions of an upper that is attached with a sole structure to form a full article of footwear. Generally it may be understood that the embodiments are not limited to any type of upper and properties of any upper could be varied accordingly in other embodiments. An upper could be formed from a variety of different manufacturing techniques, resulting in various kinds of upper structures. For example, in some embodiments, an upper could have a braided construction, a knitted (e.g., warp-knitted) construction, or some other woven construction.

Generally, a sole structure may be configured to provide various functional properties for an article, including, but not limited to, providing traction/grip with a ground surface as well as attenuating ground reaction forces when compressed between the foot and the ground during walking, running, or other ambulatory activities (e.g., providing cushioning). The configuration of a sole structure may vary significantly in different embodiments to include a variety of conventional or non-conventional structures. In some cases, the configuration of a sole structure can be configured according to one or more types of ground surfaces on which the sole structure may be used. Examples of ground surfaces include, but are not limited to, natural turf, synthetic turf, dirt, hardwood flooring, as well as other surfaces.

As used herein, a sole structure can include one or more distinct sole components. In some embodiments, a sole structure can include an insole. In some embodiments, a sole structure can include a midsole. In some embodiments, a sole structure can include an outsole. The exemplary embodiments include sole structures including a midsole and a plurality of outer sole members (or pads). Together the outer sole members may be considered to comprise the outsole of the sole structure. As discussed in further detail below, the outer sole members may be disjoint (separated) pieces of outsole material that are sized, shaped and positioned to provide variations in traction at selective locations of the sole structure. It may be appreciated that in each of the following embodiments one or more of these components of the sole structure could be optional.

In some embodiments, a midsole component may extend from a forefoot region through a midfoot region and to a heel region of a sole structure. In some embodiments, the midsole component may be a continuous, one-piece component that extends from the forefoot region to the heel region of the sole structure. In other embodiments, the midsole component may include multiple pieces or may include a gap or space in any of the regions. That is, in some embodiments, the midsole component may be separated into two or more pieces and/or may include voids.

In different embodiments, the midsole component may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

Generally, an outer sole member may be configured as a ground-contacting member. In some embodiments, an outer sole member could include properties associated with outsoles, such as durability, wear resistance, and increased traction. In other embodiments, an outer sole member could include properties associated with a midsole, including cushioning, strength, and support. In the exemplary embodiment, the plurality of outer sole members may be configured as outsole-like members that enhance traction with a ground surface while maintaining wear resistance.

In some embodiments, an inner surface of the outer sole members may be disposed against the midsole component. The outer surface of the outer sole members may face outwardly and may be a ground-contacting surface.

In different embodiments, the materials and/or physical properties of an outer sole member could vary. In some embodiments, an outer sole member could have a relatively high coefficient of friction when compared to a midsole component. For example, in one exemplary embodiment, an outer sole member may have a first coefficient of friction with a predetermined material (e.g., wood, laminate, asphalt, concrete, etc.) and a midsole component may have a second coefficient of friction with the same predetermined material. In some embodiments, the first coefficient of friction is greater than the second coefficient of friction so that the outer sole member provides increased traction (or grip) with the predetermined material in comparison to the midsole component. In at least some embodiments, the predetermined material may be associated with a type of ground surface. For example, the predetermined material could be wood associated with wood flooring in basketball courts. In other embodiments, the predetermined material could be laminate material that may also be associated with some kinds of courts. In still other embodiments, the predetermined material could be asphalt. In still other embodiments, the predetermined material could be concrete.

Increased friction with a ground surface can be achieved by utilizing materials having higher coefficients of friction and/or by providing surface features that enhance grip with the ground. Such features could include tread elements such as ridges, hemispheric protrusions, cylindrical protrusions as well as other kinds of tread elements.

In different embodiments, the densities of an outer sole member and/or a midsole component could vary. In some embodiments, an outer sole member may have a higher density than a midsole component, thereby allowing for increased durability and wear resistance for the outer sole member. In other embodiments, however, the density of the outer sole member could be equal to the density of the midsole component, or could be less than the density of the midsole component.

Outer sole members could be manufactured from a variety of different materials. Exemplary materials include, but are not limited to, rubber (e.g., carbon rubber or blown rubber), polymers, thermoplastics (e.g., thermoplastic polyurethane), as well as possibly other materials. In contrast, midsole components may generally be manufactured from polyurethane, polyurethane foam, other kinds of foams as well as possibly other materials. In some embodiments, the midsole component may utilize polymer foams. In some embodiments, the midsole component may utilize ethylvinylacetate and polyurethane foam. In still further embodiments, the midsole component may be formed from a polyurethane foam having a specific gravity of approximately 0.22. It will be understood that the type of materials for the outer sole members and a midsole component could be selected according to various factors including manufacturing requirements and desired performance characteristics. In an exemplary embodiment, suitable materials for the outer sole members and the midsole component could be selected to ensure the outer sole members have a larger coefficient of friction than the midsole component, especially when these components are in contact with hardwood surfaces, laminate surfaces, asphalt, as well as other surfaces where a sole structure may be most commonly used.

The sole structures of the present embodiments all include auxetic features. Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Some of the sole structures shown in the figures as described further in detail below, have an auxetic structure or configuration. Sole structures comprising auxetic structures are described in Cross, U.S. Patent Application Publication No. 2015/0075033, published Mar. 19, 2015 and entitled "Auxetic Structures and Footwear with Soles Having Auxetic Structures" (the "Auxetic Structures application"), the entirety of which is hereby incorporated by reference.

As described in the Auxetic Structures application, auxetic materials have a negative Poisson's ratio, such that when they are under tension in a first direction their dimensions increase both in the first direction and in a second direction orthogonal or perpendicular to the first direction.

The auxetic properties of the illustrated embodiments are achieved, at least in part, by using through-holes or blind-holes arranged in a particular pattern (an 'auxetic pattern' or 'auxetic configuration') that ensures tension applied along one axis parallel with the sole structure surface will expand the sole structure along that axis as well as along a perpendicular axis that is also parallel with the sole structure (i.e., along two perpendicular axes in the plane of the sole structure). As used herein, the term "hole" refers to any hollowed area or recessed area in a component. In some cases, a hole may be a through hole, in which the hole extends between two opposing surfaces of a component. In other cases, a hole may be a blind-hole, in which the hole may not extend through the entire thickness of the component and may therefore only be open on one side. Moreover, as discussed in further detail below, a component may utilize a combination of through holes and blind-holes. Furthermore, the term "hole" may be used interchangeably in some cases with "aperture", "recess", or "opening".

An auxetic through hole may be understood to pass through the entire thickness of a component (e.g., a midsole), or of a discrete layer of a component when the component includes two or more separate layers. However, the degree to which an auxetic blind hole may extend through the thickness of a component can vary. Thus it may be appreciated that some auxetic blind holes may be relatively shallow while other auxetic blind holes may be relatively deep when compared with the overall thickness of a component (or layer of a component) at the location of the hole.

Embodiments can make use of any of the auxetic holes, including both the size, shape and arrangement, that are disclosed in Cross, U.S. patent application Ser. No. 14/643,089, filed Mar. 10, 2015, (currently U.S. Pat. No. 9,456,656), titled "Midsole Component and Outer Sole Members with Auxetic Structure," the entirety of which is herein incorporated by reference as well as any holes disclosed in Cross, U.S. patent application Ser. No. 14/643,161, filed Mar. 10, 2015, (currently U.S. Pat. No. 9,554,622) titled "Multi-Component Sole Structure Having an Auxetic Configuration," the entirety of which is also herein incorporated by reference. In addition, embodiments can make use of any of the auxetic holes, including both the size, shape and arrangement, that are disclosed in Cross, U.S. patent application Ser. No. 14/643,121, filed Mar. 10, 2015, (currently U.S. Pat. No. 9,538,811) titled "Sole Structure with Holes Arranged in Auxetic Configuration," the entirety of which is herein incorporated by reference.

In some embodiments, an article and a corresponding sole structure may be configured to complement the natural motion of the foot during running or other activities. In some embodiments, a sole structure may have a structure that cooperatively articulates, flexes, stretches, or otherwise moves to provide an individual with a sensation of natural, barefoot running. In contrast to barefoot running, however, the sole structure may attenuate ground reaction forces and absorb energy to cushion the foot and decrease the overall stress upon the foot.

As discussed in further detail below, each of the embodiments disclosed herein may include one or more sipes. A sipe may be any cut, groove or incision in a portion of a sole structure that allows two adjacent sections of the sole structure to partially separate or flex at the sipe. In some cases, the use of sipes throughout the sole structure, or within predefined zones or regions, may help improve the degree to which the sole structure can accommodate natural motions of the foot.

As previously mentioned, the embodiments of the figures may include one or more outer sole pads (or outsole pads).

In contrast to some outsoles that primarily covers the entirety of the bottom (or outer) surface of a midsole, outer sole pads may be discrete portions or regions of outsole-like material that are selectively placed at various locations throughout the sole structure.

Generally, a sole structure could incorporate any number of outer sole members. In some embodiments, only a single outer sole member may be present. In another embodiment, only two outer sole members may be used. In still another embodiment, only three outer sole members could be used. In still other embodiments, four or more outer sole members could be used.

FIG. 1 is a schematic bottom view of a sole structure 100. Sole structure 100 may include a plurality of auxetic openings 102 arranged within a central region 101 of sole structure 100. In some cases, plurality of auxetic openings 102 may be surrounded by a plurality of sipes 104 that extend from the central region and through a peripheral region 109 of sole structure 100. In some cases, at least one of the plurality of sipes 104 intersects one of the plurality of auxetic openings (e.g., sipe 105 intersects auxetic opening 107).

Some of the features of sole structure 100 are described here. In some embodiments, sole structure 100 has a midsole component 110 with an inner recessed surface 112 and an outer surface 114. The midsole component 110 includes a plurality of recessed portions (i.e., auxetic openings 102) that are arranged in an auxetic configuration in the outer surface. The plurality of recessed portions include a first recessed portion 120. The first recessed portion 120 is bordered by at least a first sole portion 122 and a second sole portion 124. The first sole portion 122 and the second sole portion 124 are connected by a junction 126. The first sole portion 122 has a first elevated portion with a first elevated surface 127 and the second sole portion 124 has a second elevated portion with a second elevated surface 128. The first elevated surface 127 is located a first distance away from the inner recessed surface 112. The second elevated surface 128 is located a second distance away from the inner recessed surface 112. The junction 126 has a junction surface 134 and the junction surface 134 is located a third distance away from the inner recessed surface 112. The first distance and the second distance are both larger than the third distance. Thus it may be appreciated that the thickness of junction 126 is less than the individual sole portions, thereby allowing the sole portions to bend and/or flex with respect to one another about junction 126. Moreover, the remaining sole portions of sole structure 100 may also be configured in this way, being joined to adjacent sole portions by a thinner junction or connecting portion, which helps facilitate auxetic expansion of some regions of sole structure 100.

Sole structure 100 may also incorporate any of the features, provisions, components, functionalities and/or materials that are disclosed in U.S. patent application Ser. No. 14/826,901, filed Aug. 14, 2015 (currently U.S. Pat. No. 9,635,903), titled "Sole Structure Having Auxetic Structures and Sipes," the entirety of which is herein incorporated by reference and which is hereafter referred to as 'The Sole Structure with Auxetic Structures and Sipes' application. It may be appreciated that other embodiments shown in the figures may also incorporate any of these provisions as disclosed in The Sole Structure with Auxetic Structures and Sipes application.

Figure 2:
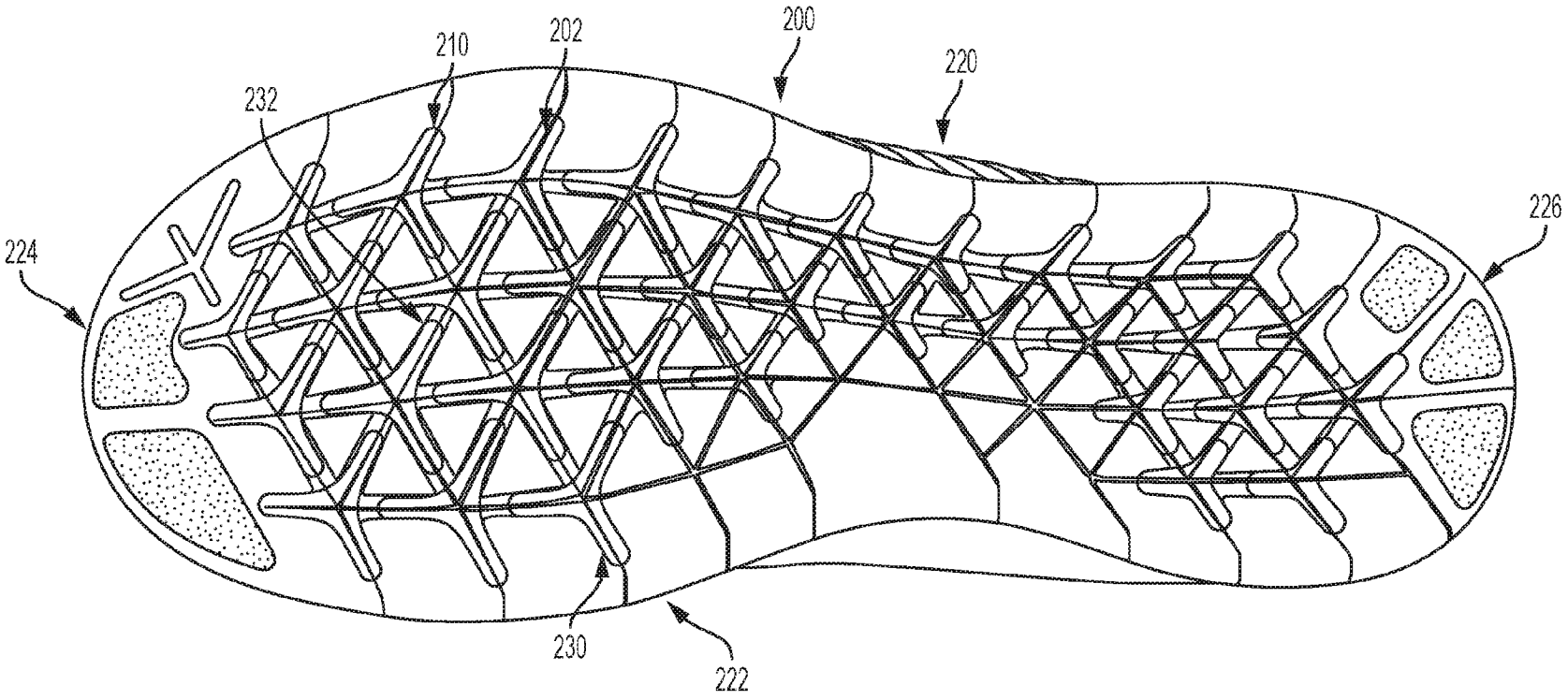
FIGS. 2-4 are schematic bottom views of an embodiment of a sole structure with auxetic openings and sipes.
Figure 3:
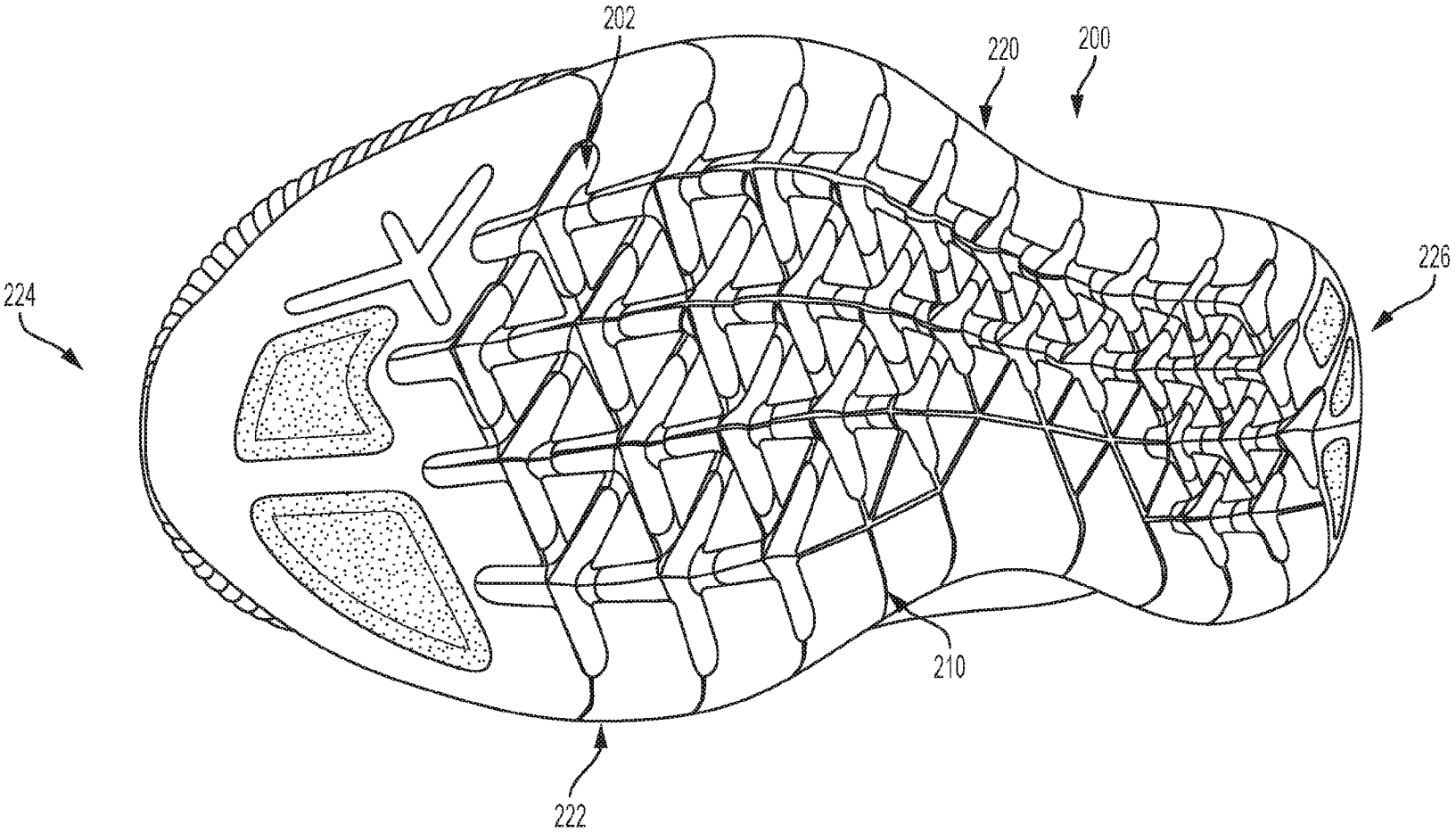
Figure 4:
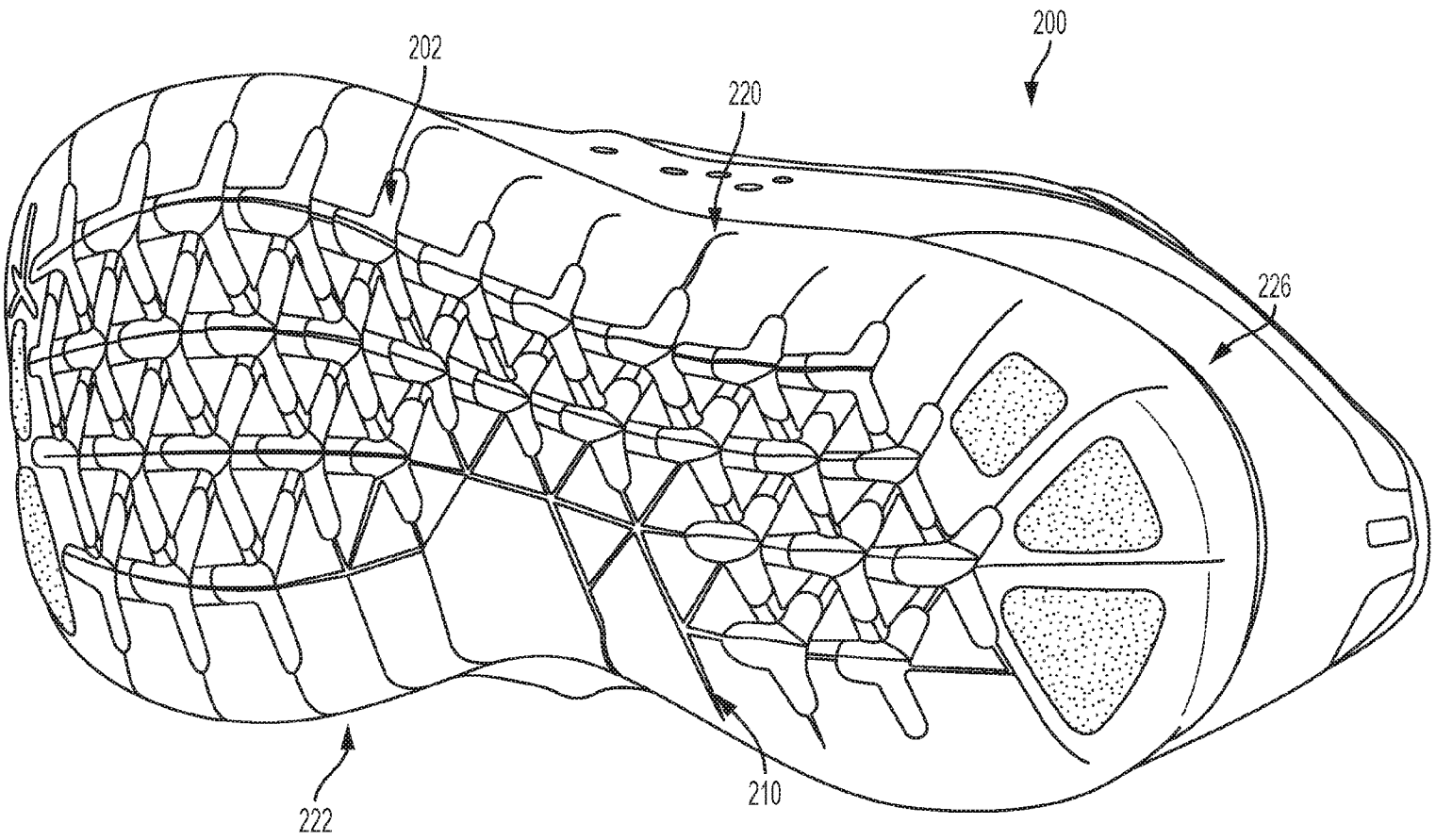

FIGS. 2-4 illustrate various schematic views of an embodiment of a sole structure 200. Sole structure 200 also includes a plurality of auxetic openings 202 and a plurality of sipes 210. Plurality of sipes 210 are seen to intersect the arm-like portions of auxetic openings 202 such that the center of each auxetic opening includes the intersection of at least three different sipes (oriented in 3 different directions).

Referring to FIG. 2, sole structure 200 has a lateral edge 220 and a medial edge 222 and the sole structure has a toe edge 224 and a heel edge 226. The sole structure includes a first plurality of sipes 230 (comprises of multiple parallel sipes) and a second plurality of sipes 232 (comprised of multiple parallel sipes oriented in a different direction from sipes 230). The first plurality of sipes 230 extend from the medial edge 222 of the sole structure 200 toward the lateral edge 220 of the sole structure 200. Each sipe of the first plurality of sipes 230 extends from a first position along medial edge 222 to a second position between the medial edge 222 and the lateral edge 220. The first position is located closer to the heel edge 226 than the second position. The second plurality of sipes 232 extend from the lateral edge 220 of the sole structure 200 toward the medial edge 222 of the sole structure 200. Each sipe of the second plurality of sipes 232 extends from a third position along the lateral edge 220 to a fourth position between the lateral edge 220 and the medial edge 222. The third position is located closer to the heel edge 226 than the fourth position. Both sets of sipes include sipes in the forefoot region, midfoot region and heel region of the sole structure 200. Such a configuration may provide selective torsional rigidity through the sole structure such that one edge of the sole structure may flex more than an opposing edge, depending on the direction of torsion.

Sole structure 200 may also incorporate any of the features, provisions, components, functionalities and/or materials that are disclosed in U.S. patent application Ser. No. 14/826,879, filed Aug. 14, 2015, (currently U.S. Pat. No. 9,668,542), titled "Sole Structure Including Sipes", the entirety of which is herein incorporated by reference and which is hereafter referred to as 'The Sole Structure with Sipes' application. It may be appreciated that other embodiments shown in the figures may also incorporate any of these provisions as disclosed in The Sole Structure with Sipes application.

The embodiments of the present application include various arrangements of auxetic openings, sipes and outsole pads. Generally, these various features are configured in a regional, or local, manner throughout the various embodiments shown in FIGS. 5-19.

The following description is directed to various features of one or more embodiments shown in FIGS. 5-19. Specifically, FIGS. 5-7 include schematic views of an embodiment, FIGS. 8-10 include schematic views of another embodiment, FIGS. 11-13 include schematic views of still another embodiment, FIGS. 14-15 include schematic views of still another embodiment, FIGS. 16-17 include schematic views of still another embodiment and FIGS. 18-19 include schematic views of yet another embodiment. It may be appreciated that some features may be common to two or more different embodiments while other features may be shown in only one embodiment. However, each of the features disclosed and shown in the figures could also be incorporated into any other embodiments.

Generally, a sole structure for an article of footwear can include two or more distinct regions, such as a first region and a second region. The first region and second region could be any two non-overlapping regions of an article. In the description below, the first region may be a forefoot region and the second region may correspond with part of the midfoot region and part of the heel region of the sole structure. Moreover, in some cases, the first region and/or the second region could be disposed in a central region or area of the sole structure, which is disposed inwardly of a peripheral portion.

Figure 5:
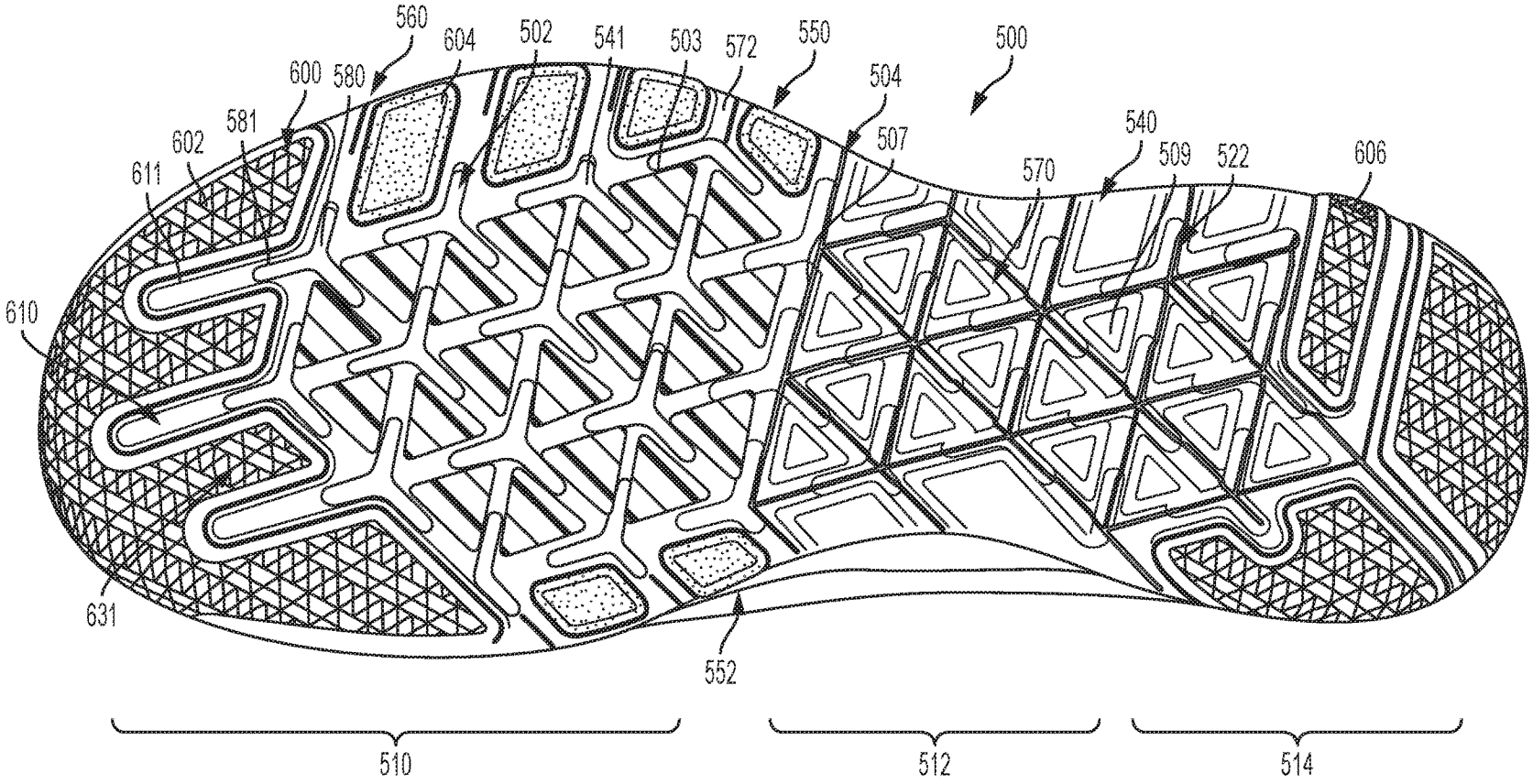
FIGS. 5-7 are schematic bottom views of an embodiment of a sole structure with regionally applied auxetic openings and sipes.
Figure 6:
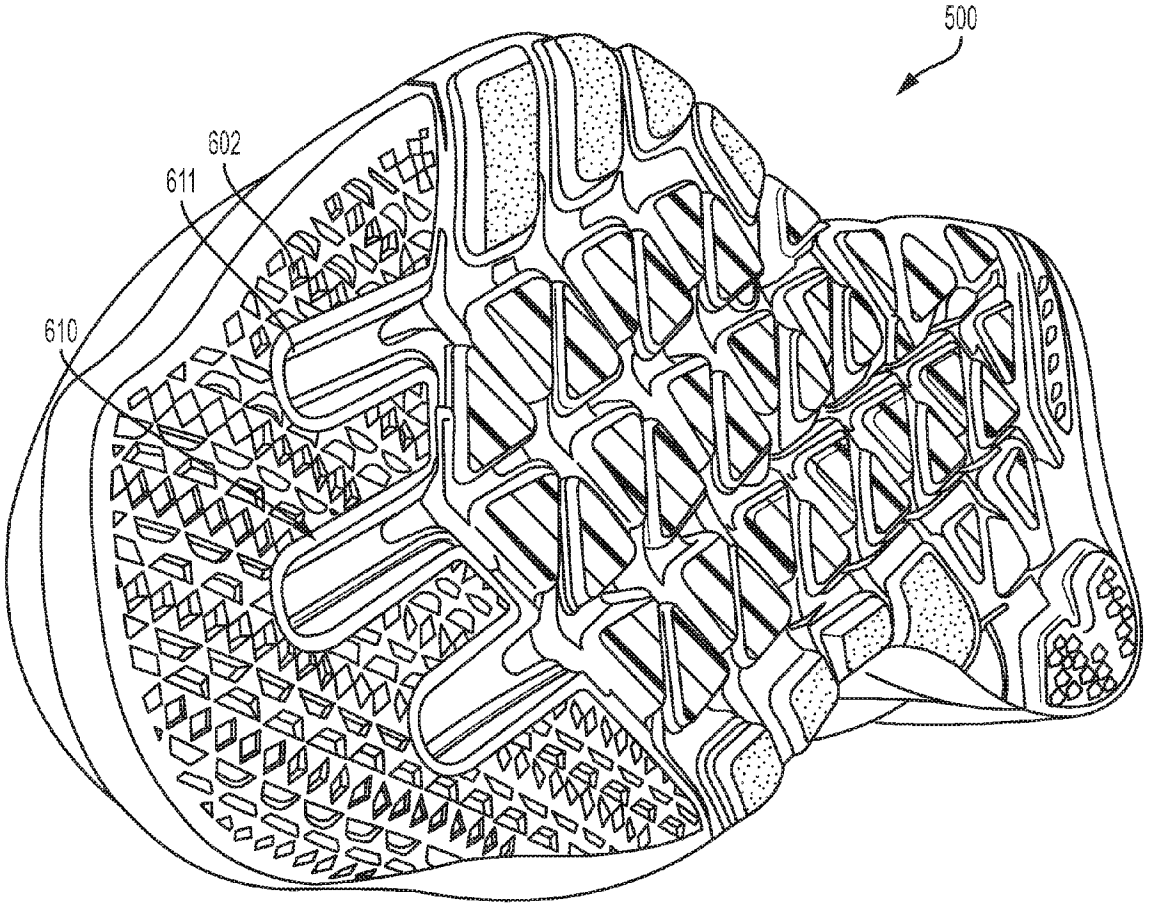
Figure 7:
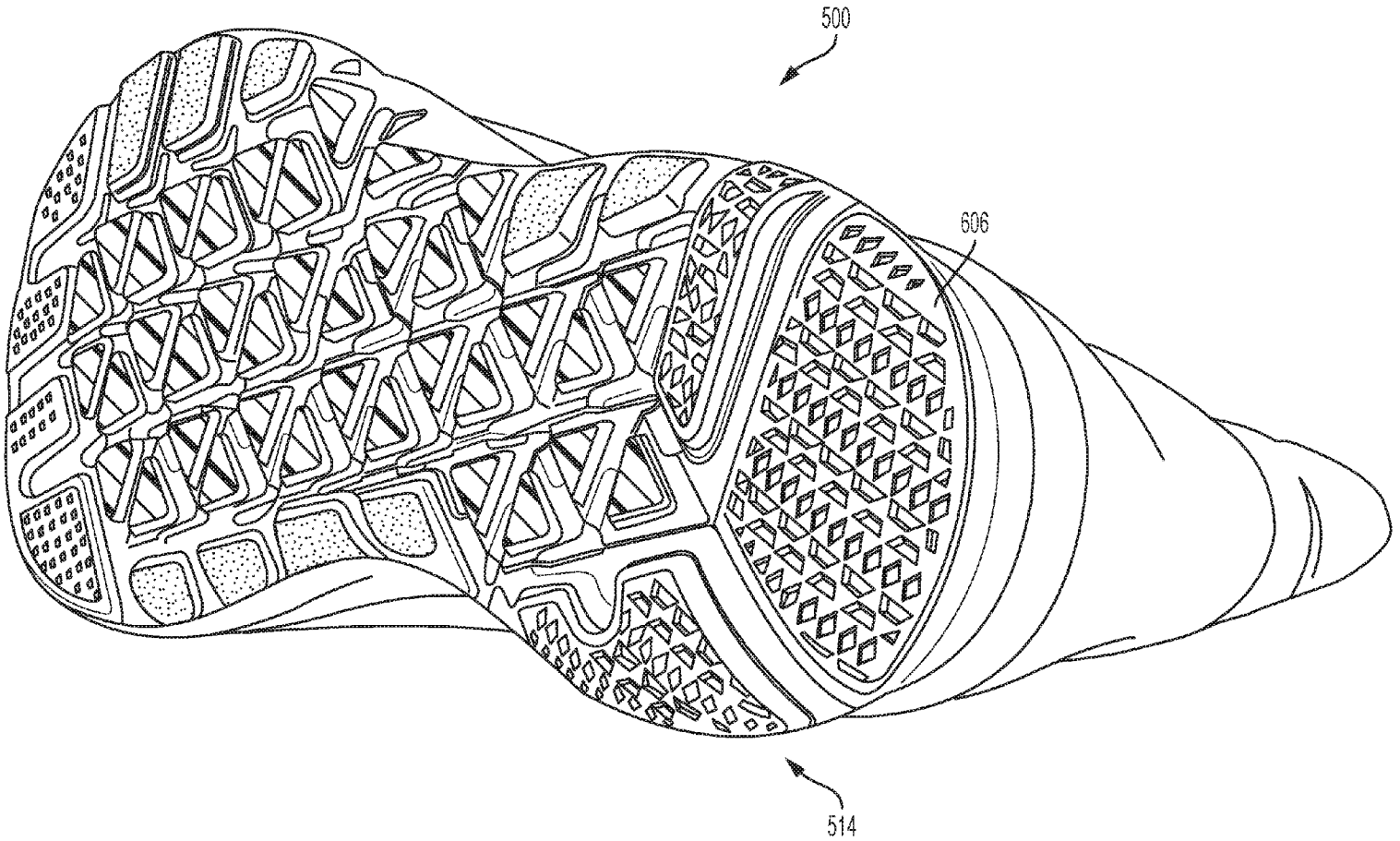

Referring to FIGS. 5-7, a sole structure 500 is comprised of a midsole component 540 and a plurality of outer sole members 600. Sole structure 500 is also seen to have auxetic openings selectively applied in specific regions. Specifically, sole structure 500 incorporates a plurality of auxetic openings 502 (or simply openings 502) in a forefoot region 510. Although midfoot region 512 and heel region 514 are also seen to include another set of auxetic openings 522 (or simply openings 522), these openings 522 may be distinct from openings 502 in at least some embodiments. In some cases, for example, openings 502 in forefoot region 510 may be deeper than openings 522. Moreover, in at least some cases, openings 502 may be through holes so that the sidewalls of sole portions 503 surrounding openings 502 are not continuously formed with inner surface 541 of midsole 540. In such cases, sole portions 503 may move more freely and thereby facilitate a greater auxetic effect than with more shallow auxetic openings, including auxetic blind holes. Additionally, because openings 522 are intersected by sipes (discussed below), openings 522 may provide less of an auxetic effect than openings 502 that are surrounded by a continuously extending peripheral wall formed by the surrounding sole portions.

Sole structure 500 is also seen to include sipes that are selectively applied in specific regions. Specifically, sole structure 500 incorporates a plurality of sipes 504 (or simply sipes 504) in midfoot region 512 and heel region 514. Sipes 504 each extend through a central portion 570 of sole structure 500 and through at least one of a lateral edge 550 or medial edge 552 of sole structure 500. Moreover, each sipe extends through at least one of openings 522. Although sole structure 500 does include a set of sipes 560 in forefoot region 510, these sipes are seen to only extend through a periphery 572 of sole structure 500.

This arrangement provides a regional separation of particular structural features in the sole structure, which may provide distinct types of functionality. In this case, openings 502 are arranged in an auxetic configuration and disposed centrally within forefoot region 510 (e.g., a first region that is disposed within a periphery of a sole structure). Furthermore, sipes 504 are disposed in midfoot region 512 and heel region 514 (a second region). In forefoot region 510 every sole portion of sole portions 503 is continuously connected to at least one other sole portion in sole portions 503 by a junction. Thus, forefoot region 510 is provided with a connected geometry that facilitates cooperation among sole portions 503 to enable auxetic expansion. In contrast, sipes 504 divide midsole component 540 into a set of separated sole portions 509 such that every sole portion in sole portions 509 is separated from any adjacent sole portion by a sipe from sipes 504. Thus, midfoot region 512 and heel region 514 are provided with a disconnected geometry that allows adjacent sole portions to flex independently in order to maximize flexibility in the arch and heel. In the embodiment shown in FIG. 5, forefoot region 510 (or a first region) is divided from midfoot region 512 (or part of a second region) by a single sipe 507.

By selectively applying auxetic openings (i.e., through hole openings or relatively deeper auxetic openings) to forefoot region 510, sole structure 500 may be configured to undergo the greatest amount of auxetic expansion in forefoot region 510. This may help in increasing the ground contact area with a surface as the forefoot is planted, and may also help improve feel in the forefoot due to the greater uniform flexibility from auxetic expansion. Furthermore, by selectively applying sipes 504 through midfoot region 512 and heel region 514, torsional rigidity in midfoot region 512 and heel region 514 may be greater than in forefoot region 510. This may ensure the heel and arch can be twisted or turned as needed in the desired direction while maintaining stability along the planted edge of the sole structure.

Sole structure 500 may also be provided with various outer sole members 600 that are seen to have treaded surfaces. As seen in FIGS. 5-7, outer sole members 600 include an outer sole member 602 disposed at a forward edge, or toe region, of sole structure 500, a set of outer sole members 604 disposed on the peripheral edges of forefoot region 510 and another set of outer sole members 606 disposed in heel region 514.

Outer sole member 602 comprises a continuous region of tread material and includes a plurality of slotted regions 610. Each of slotted regions 610 may separate adjacent 'finger-like' portions of outer sole member 602. For example, slotted regions 610 form four finger portions 631 extending approximately in a longitudinal direction of sole structure 500. Each of slotted regions 610 are further seen to correspond with an arm portion of an opening in auxetic openings 502. Thus, for example, an opening 580 has an arm portion 581 that is aligned with, and partially inserted into, a slotted region 611 of outer sole member 602. Likewise, two additional openings each include an arm portion aligned with and partially inserted into a corresponding slotted region. Such a correspondence between slotted regions in an outer sole member and portions of auxetic openings may provide increased cooperation during auxetic expansion. Specifically, as each arm portion of openings 502 expands under an applied tension, the slotted regions 610 may widen accordingly so as not to inhibit the auxetic expansion of the sole adjacent to outer sole member 602.

Figure 18:
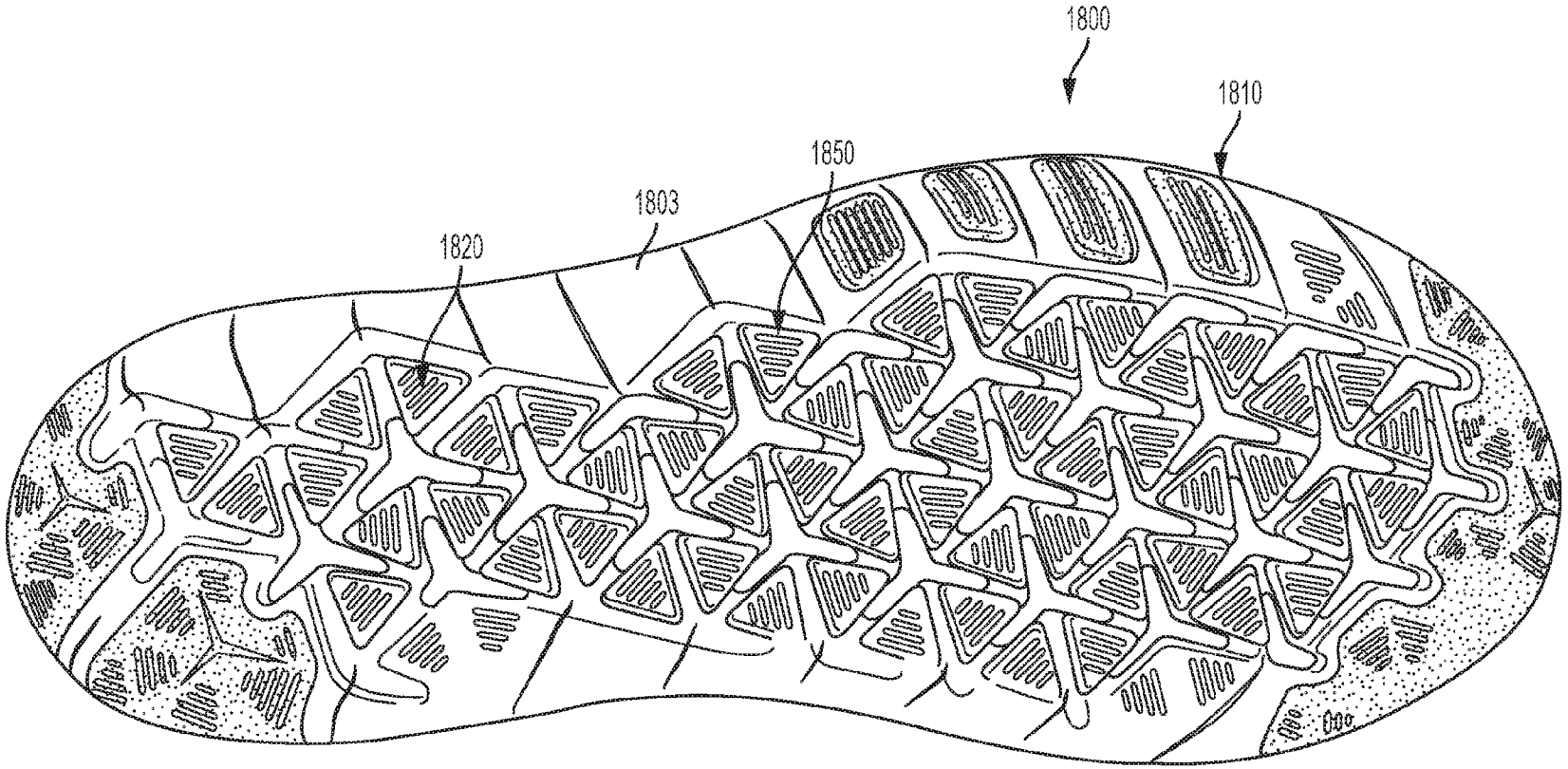
FIGS. 18-19 are schematic bottom views of an embodiment of a sole structure with auxetic openings and sipes.
Figure 19:
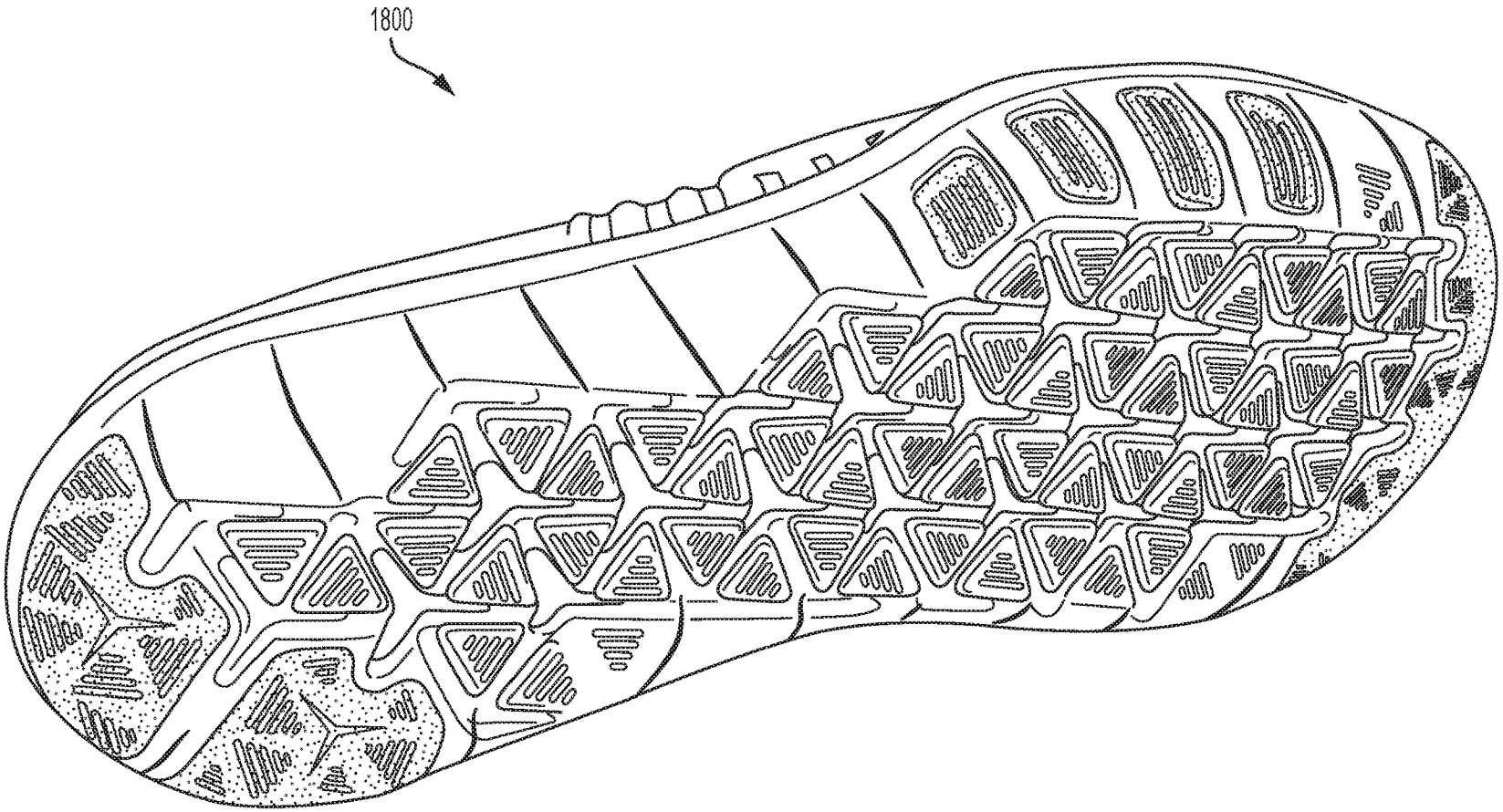

The figures in fact include multiple embodiments where there is a correspondence between slots in an outer sole member and portions of an auxetic opening. In particular, this arrangement is shown in at least sole structure 1100 (FIGS. 11-13), sole structure 1600 (FIGS. 16-17) and in sole structure 1800 (FIGS. 18-19). As seen from these embodiments, the length of the slotted regions as well as the extent to which an auxetic opening is inserted within the slotted regions may vary from one embodiment to another.

The embodiment of FIGS. 5-7, as well as embodiments of other figures include various sole portions that are defined relative to auxetic openings and/or sipes. The shapes and sizes of these sole portions could vary from one embodiment to another. The embodiments of the figures use auxetic openings with a 3 pointed star geometry (including rounded vertices), which result in approximately triangular (cross-sectional) shapes for the corresponding sole portions. Similarly, the sipes of the embodiments in the figures are arranged to divide the midsole into triangular sole portions, at least inwardly of the peripheral edges (at the peripheral edges the sole portions may be irregular or rectangular). Of course in other embodiments the sole portions could have different shapes and/or sizes according to the type of auxetic pattern (e.g., hole shape) used as well as according to the number and arrangements of sipes used.

Figure 8:
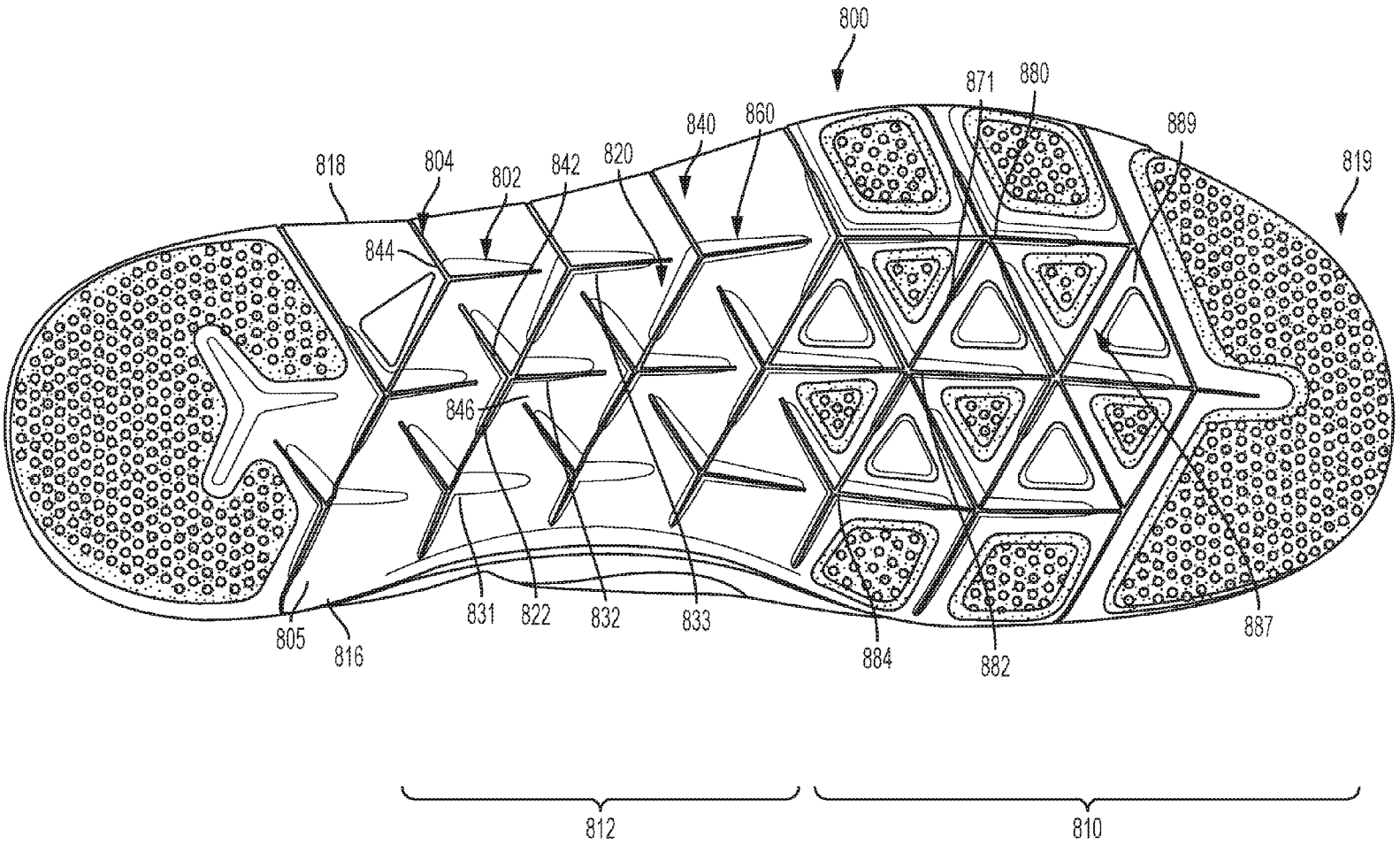
FIGS. 8-10 are schematic bottom views of another embodiment of a sole structure with regionally applied auxetic openings and sipes.
Figure 9:
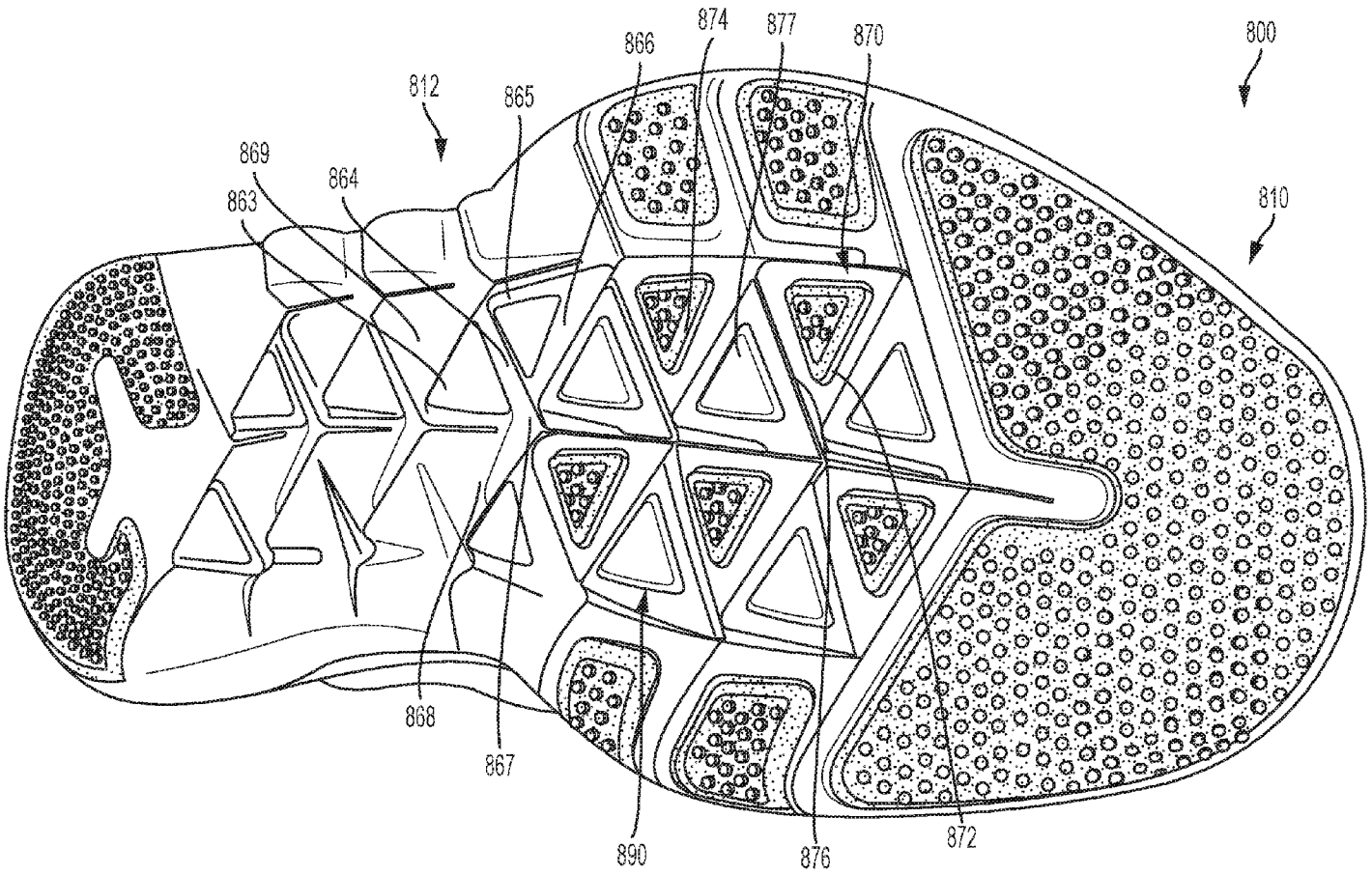
Figure 10:
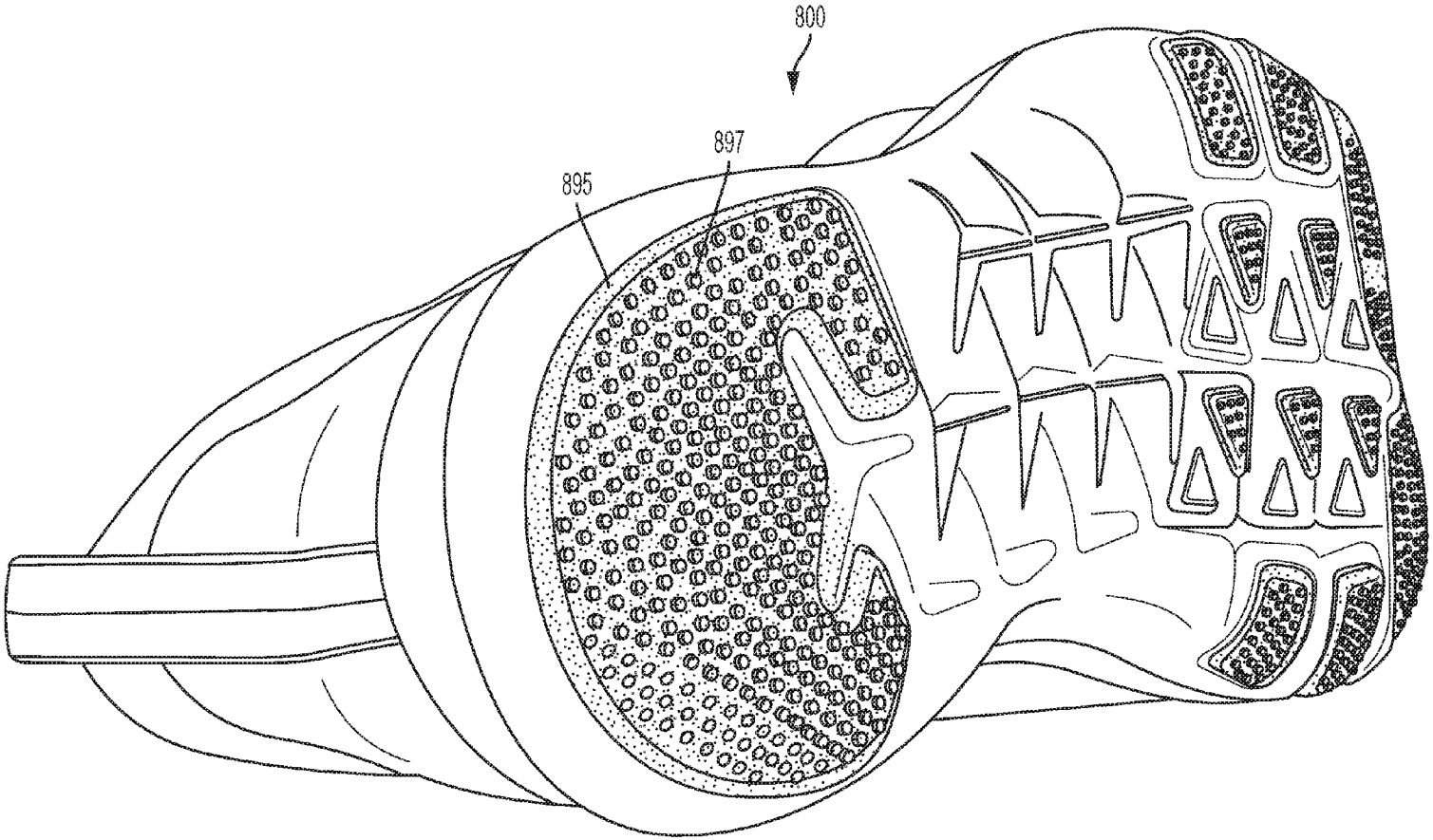
Figure 11:
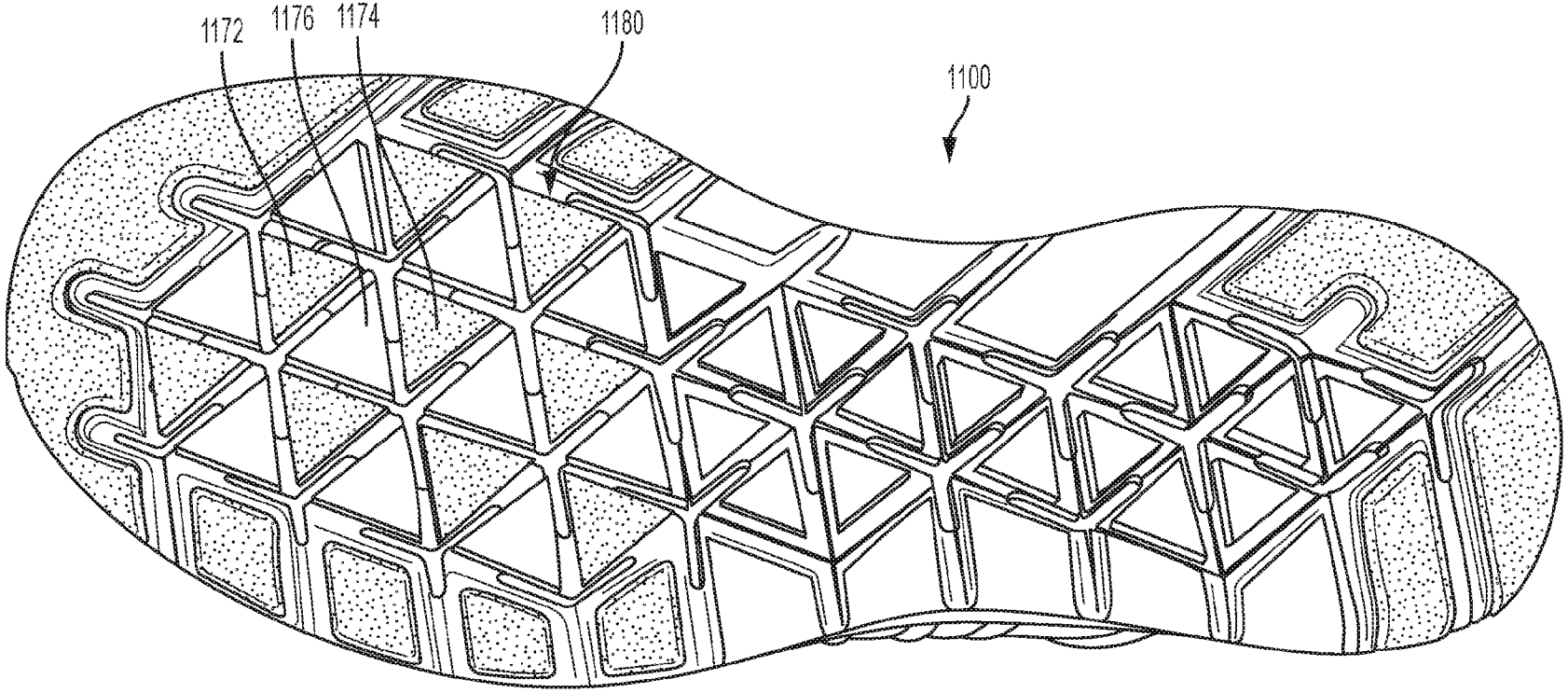
FIGS. 11-13 are schematic bottom views of an embodiment of a sole structure with an alternating pattern of outsole members in a forefoot region.
Figure 12:
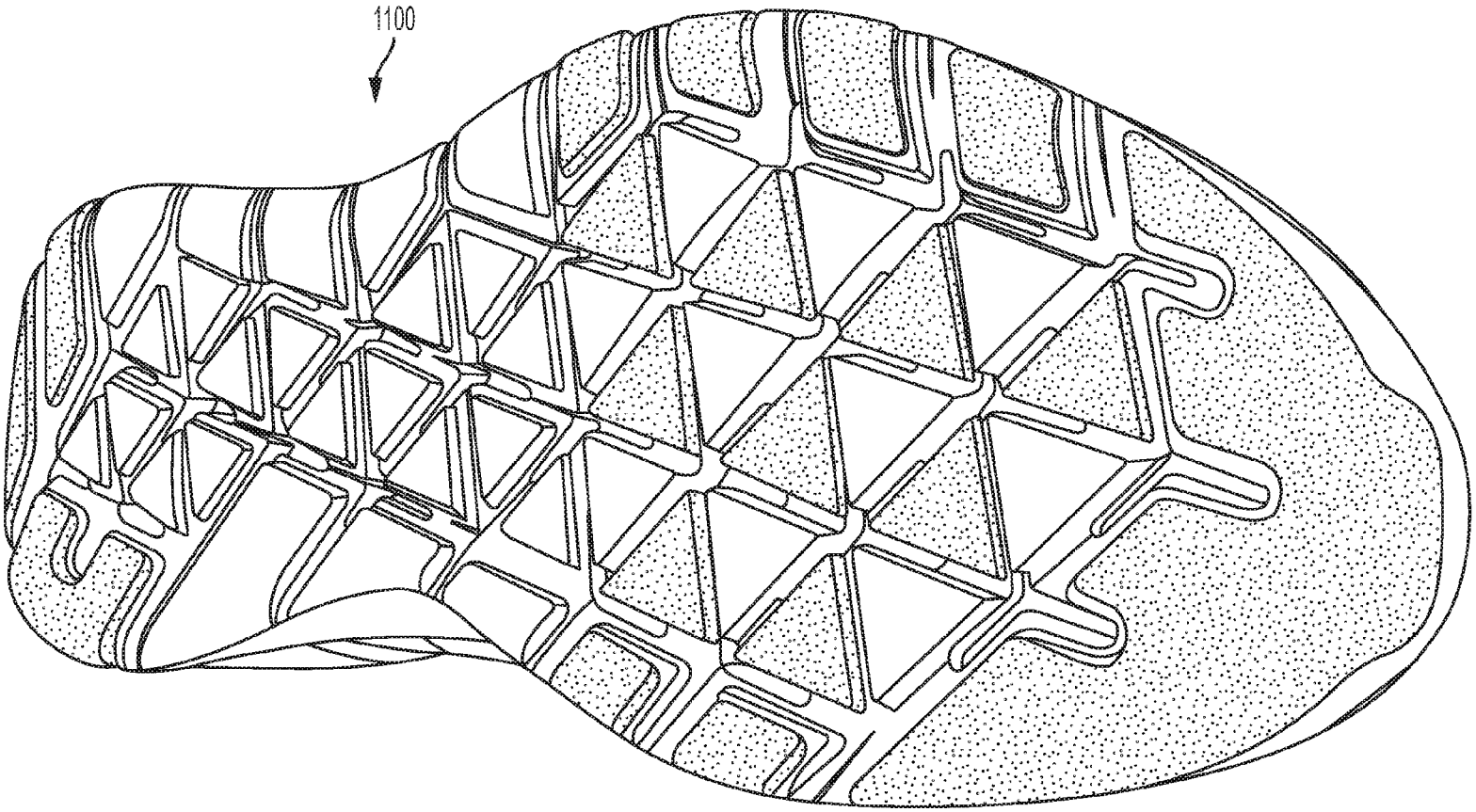
Figure 13:
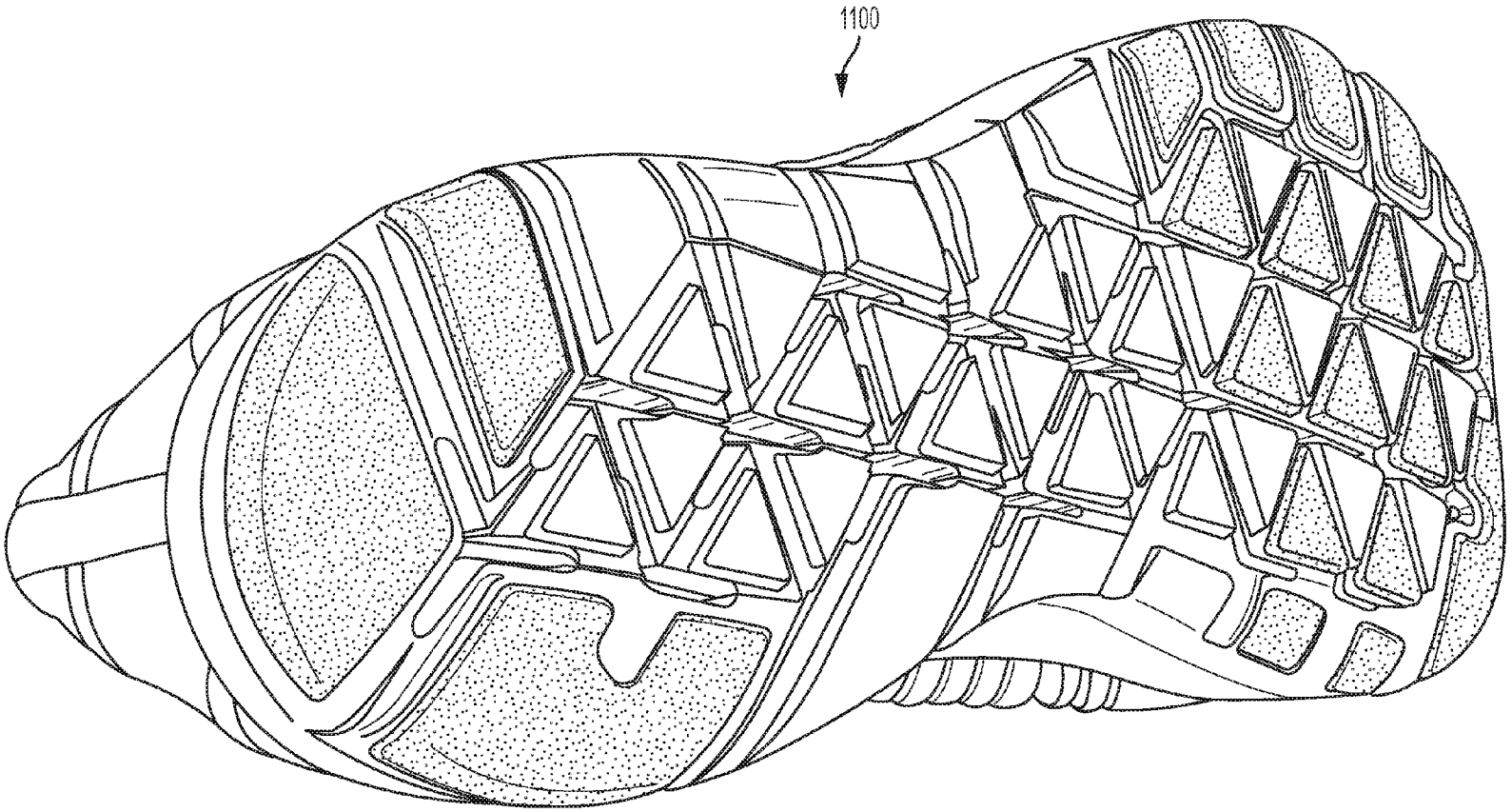
Figure 14:
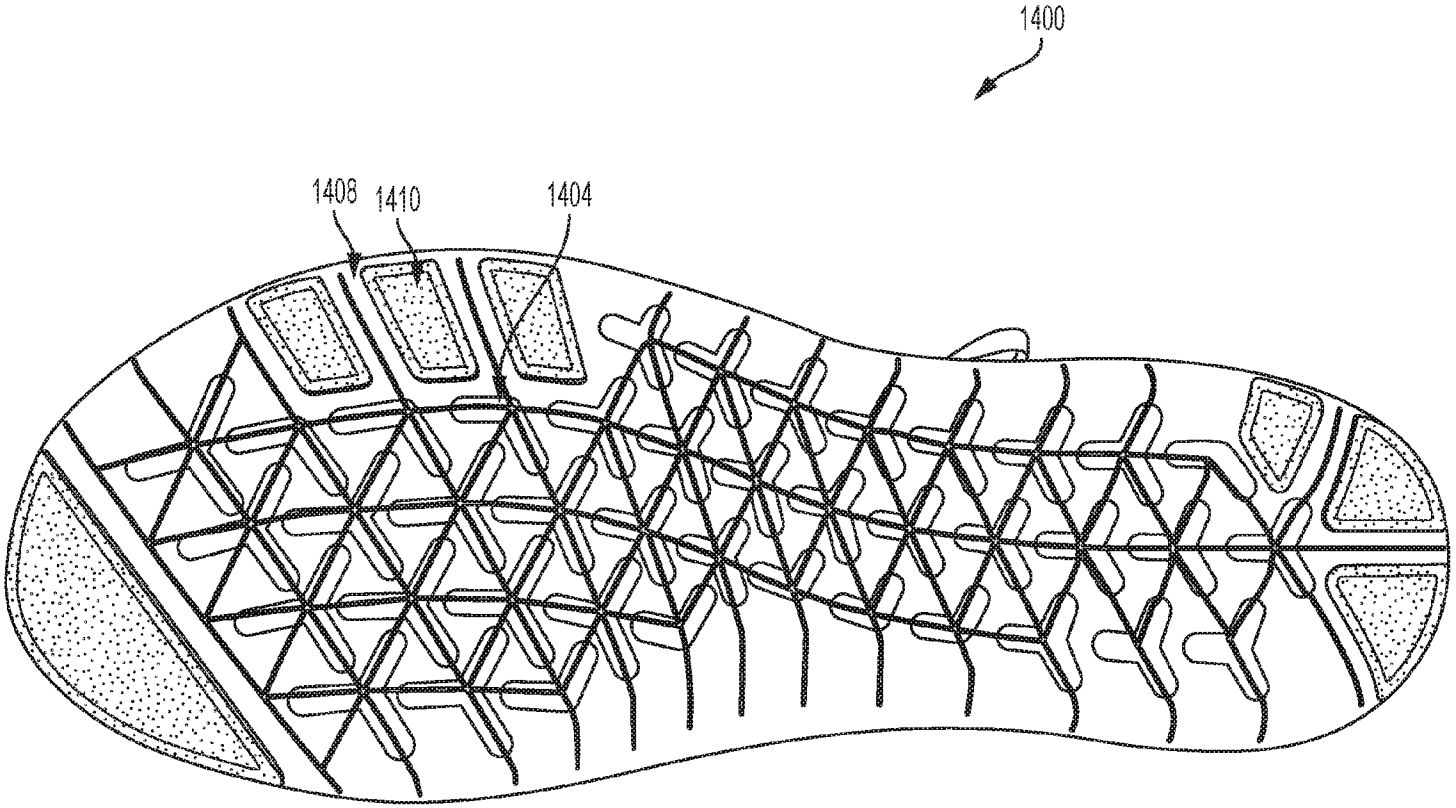
FIGS. 14-15 are schematic bottom views of an embodiment of a sole structure with auxetic openings and sipes.

FIGS. 8-10 illustrate schematic views of an embodiment of a sole structure 800. As with previous embodiments, and best shown in FIG. 8, sole structure 800 incorporates both auxetic openings 802 and sipes 804 in midsole component 805. In this embodiment, openings 802 are blind holes or indentations within midsole component 805. More specifically, each auxetic opening may be intersected by one or more sipes. In contrast to sole structure 200 (FIGS. 2-4), sole structure 800 provides a pattern of intersection that varies regionally. Specifically, in midfoot region 812 the sipes may be characterized as a first set of sipes 820 that extend continuously from medial edge 816 towards lateral edge 818 (moving closer to toe edge 819 as the sipe approaches lateral edge 818) with each sipe intersecting three different auxetic openings. For example, sipe 822 extends from medial edge 816 towards lateral edge 818 and intersects opening 831, opening 832 and opening 833. A second set of sipes 840 are oriented parallel with one another along a diagonal from medial edge 816 to lateral edge 818, and at an angle to the direction of set of sipes 820. Unlike first set of sipes 820, second set of sipes 840 do not extend continuously and instead comprise shorter sipes which each only extend from a center of one opening through one arm portion of the opening. For example, sipe 842 extends from a center of opening 832 through arm portion of opening 832, but is spaced apart from sipe 844 and sipe 846, which are co-linear with sipe 842. Likewise, a third set of sipes 860 running longitudinally through sole structure 800 are shorter sipes that each only extend through an arm portion of a single auxetic opening.

This intersection configuration in midfoot region 812 may be contrasted with the configuration in forefoot region 810. In forefoot region 810, each sipe extends continuously through forefoot region 810 such that each sipe of a set of sipes 887 in forefoot region 810 intersects at least two auxetic openings, and such that each sipe intersects each arm portion of an auxetic opening that is co-linear with that sipe. For example, sipe 871 extends from medial edge 816 through auxetic opening 880, auxetic opening 882 and auxetic opening 884.

The differences in sipe configurations between forefoot region 810 and midfoot region 812 results in a slightly different configuration for the sole portions defined by these sipes. In forefoot region 810, where the sipes all intersect multiple auxetic openings, sole portions 889 of midsole component 805 are completely separated from one another (i.e., adjacent sole portions are separated by sipes in the set of sipes 887). In contrast, in midfoot region 812, adjacent sole portions may be connected by one or more connecting portions. For example, as shown in FIG. 9, sole portion 864 of midfoot region 812 is connected to an adjacent sole portion 866 by connecting portion 865 and to another adjacent sole portion 868 by connecting portion 867. Here, each connecting portion is seen to be disposed between two shorter co-linear sipes. However, the other adjacent sole portion 869 to sole portion 864 is separated from sole portion 864 by a sipe 863.

This distinction in how the sipes intersect auxetic openings between forefoot region 810 and midfoot region 812 may provide a slightly different feel in these two regions. The siping pattern in forefoot region 810 may allow for more independent motion between adjacent sole portions which bound the auxetic openings, therefore enhancing flexibility and proprioception in forefoot region 810 as compared to midfoot region 812.

Figure 15:
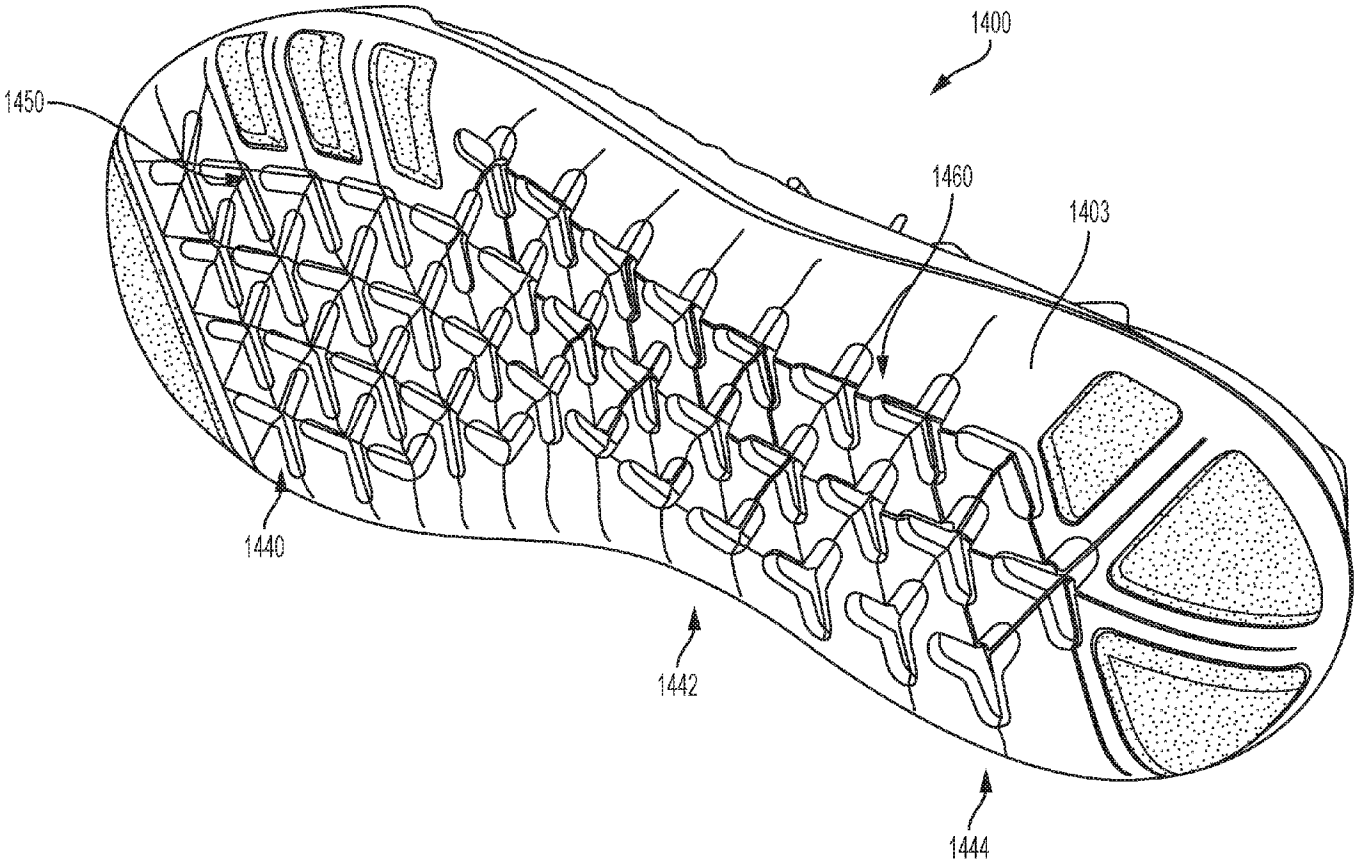

As previously discussed, the embodiments may incorporate auxetic openings or auxetic recesses with variable depths. As one example, FIG. 15 illustrates sole structure 1400 with a first set of auxetic recesses 1450, or simply auxetic recesses 1450, in forefoot region 1440 and a second set of auxetic recesses 1460, or simply auxetic recesses 1460, in midfoot region 1442 and heel region 1444. Auxetic recesses 1450 are more shallow than second set of auxetic recesses 1460. In other words, the depth of recesses 1450 as measured between an outer surface of midsole component 1403 and inner bottom surface of each recess is less than a similarly measured depth for recesses 1460. This difference in depth between the forward and rearward regions of sole structure 1400 may provide a slightly different feel in the midfoot and heel by allowing these regions to set into a ground surface (such as dirt) slightly more than the forefoot (which is flatter relative to the midfoot and rear). A similar arrangement may be seen to pertain between auxetic openings 1620 in a forefoot region of sole structure 1600 (FIGS. 16-17) and auxetic openings 1622 in the midfoot and heel regions of sole structure 1600.

In different embodiments, the number, size, geometry and arrangement of outer sole members can be varied in order to facilitate selective traction control and/or improved durability over different regions of a sole structure.

In each of the embodiments disclosed herein, outer sole members may be applied along the periphery of a sole structure, for example at a toe edge, a heel edge, along a medial edge and/or a lateral edge. In some embodiments, a sole structure may include only outer sole members at a toe edge and a heel edge and may not include any outer sole members on the lateral and medial edges. Examples of sole structures with this outer sole member pattern are shown in FIG. 1 and FIGS. 2-4. Alternatively, some embodiments include outer sole members on one or both of the lateral and/or medial edges. Examples of sole structures with this configuration are shown in the various embodiments of FIGS. 5-19.

In some cases, outer sole members on the periphery of a sole structure may correspond with distinct sole portions (that may be bounded by sipes and/or auxetic openings on three sides). In such cases, the shape and orientation of each sole structure can be selected to correspond with the shape and orientation of the underlying sole portion. As one example, and referring to FIGS. 14-15, set of outer sole members 1410 of sole structure 1400 have an approximately rectangular shape and are angled so that the peripheral edge of each outer sole member is slightly forwards of the inner edge (the edge closest to a center of sole structure 1400), which corresponds with the shape and orientation of the underlying sole portions 1408 that is defined by plurality of sipes 1404. Similarly, sole structure 1600 of FIGS. 16-17 and sole structure 1800 of FIGS. 18-19 also include sets of outer sole members (outer sole members 1610 and outer sole members 1810, respectively) that are approximately rectangular and oriented at an angle according to the underlying sole members. In contrast to outer sole members 1410, however, these outer sole members may be oriented in an opposing direction. Specifically, outer sole members 1610 and outer sole members 1810 are oriented such that their peripheral edges are slightly rearward of their inner edges, which may be seen as an approximately 90 degree rotation from the orientation of outer sole members 1410 of sole structure 1400. It may be appreciated that varying the shape and orientation of outer sole members (in addition to varying the number, size, etc.) may result in variations in traction.

As seen in FIGS. 5-19, some embodiments include outer sole members on both the lateral and medial sides of a forefoot region of a sole structure (e.g., outer sole members in sole structure 500, sole structure 800, sole structure 1100, sole structure 1600, and sole structure 1800) while in other embodiments outer sole members are selectively applied to either a lateral side or a medial side of the forefoot region (e.g., outer sole members 1410 of sole structure 1400 are disposed only on a lateral edge in a forefoot region of sole structure 1400).

As with the outer sole members disposed on the lateral and medial edges, outer sole members disposed at a toe edge or heel edge of a sole structure may in some cases have shapes, sizes and orientations corresponding to the shapes, sizes and orientations of underlying portions of midsole that may be defined or bounded by sipes and/or auxetic openings. It can also be appreciated that outer sole members (or pads) in the toe and/or heel regions can have a variety of sizes, or in other words may comprise a range of the total area of either the forefoot or the heel. In some cases, outer sole members in the forefoot and/or heel may comprise a relatively small percentage of the total area of the forefoot and/or heel (e.g., outer sole members in sole structure 100 and sole structure 200). In other cases, outer sole members in the forefoot and/or heel may comprise a relatively large percentage of the total area of the forefoot and/or heel (e.g., outer sole members in sole structure 500 and sole structure 800). It may be appreciated that outer sole members in the toe and/or heel of sole structure 1100, sole structure 1400, sole structure 1600 and sole structure 1800 may comprise areas that are intermediate to the relatively small and relatively large areas of some outer sole members discussed here.

In each of the embodiments disclosed herein, outer sole members may be applied within a central region of a sole structure (which is a region spaced inwardly from the periphery), for example in a central forefoot region, a central midfoot region or a central heel region. Some embodiments may include outer peripheral members that are disposed in a central forefoot region of a sole structure. Examples of such configurations include central forefoot outer sole members 870 in sole structure 800 (see FIG. 9), and central forefoot outer sole members 1180 in sole structure 1100 (see FIG. 11). In each of these two embodiments the outer sole members are formed atop a sole portion (e.g., a triangular sole portion) that is bounded by multiple auxetic openings (through holes). Moreover, these outer sole members are arranged in an alternating configuration so that every other sole portion along a column or row of the auxetic pattern in the forefoot region has an outer sole member. For example, in FIG. 9, outer sole member 872 and outer sole member 874 are separated by a sole portion 876 that lacks an outer sole member. Likewise, in FIG. 11, outer sole member 1172 and outer sole member 1174 are separated by a sole portion 1176 that lacks an outer sole member.

In embodiments where the underlying sole portions are triangular, an outer sole member could have a corresponding triangular shape. For example, outer sole members 870 in FIGS. 8-9 and outer sole members 1180 in FIG. 11 have triangular shapes corresponding to the shape of the underlying sole portion. In some cases, a sole portion can have a raised portion that is continuous with the midsole and configured to contact a ground surface simultaneously with an outer sole member. For example, in FIG. 9, sole portion 876 includes a raised tread feature 877 that is integral with sole portion 876 and may contact a ground surface simultaneously with outer sole member 872 and/or outer sole member 874 (i.e., feature 877 may be approximately in the same plane as outer sole members 870).

In some embodiments, a sole structure may include only outer sole members at a toe edge and a heel edge and may not include any outer sole members on the lateral and medial edges. Examples of sole structures with this outer sole member pattern are shown in FIG. 1 and FIGS. 2-4. Alternatively, some embodiments include outer sole members on one or both of the lateral and/or medial edges. Examples of sole structures with this configuration are shown in the various embodiments of FIGS. 5-19. Likewise, some embodiments include outer sole members disposed centrally to the sole structure (e.g., outer sole members in sole structure 800 and sole structure 1100) while others may not include any outer sole members inside of a peripheral region of the sole structure.

Figure 16:
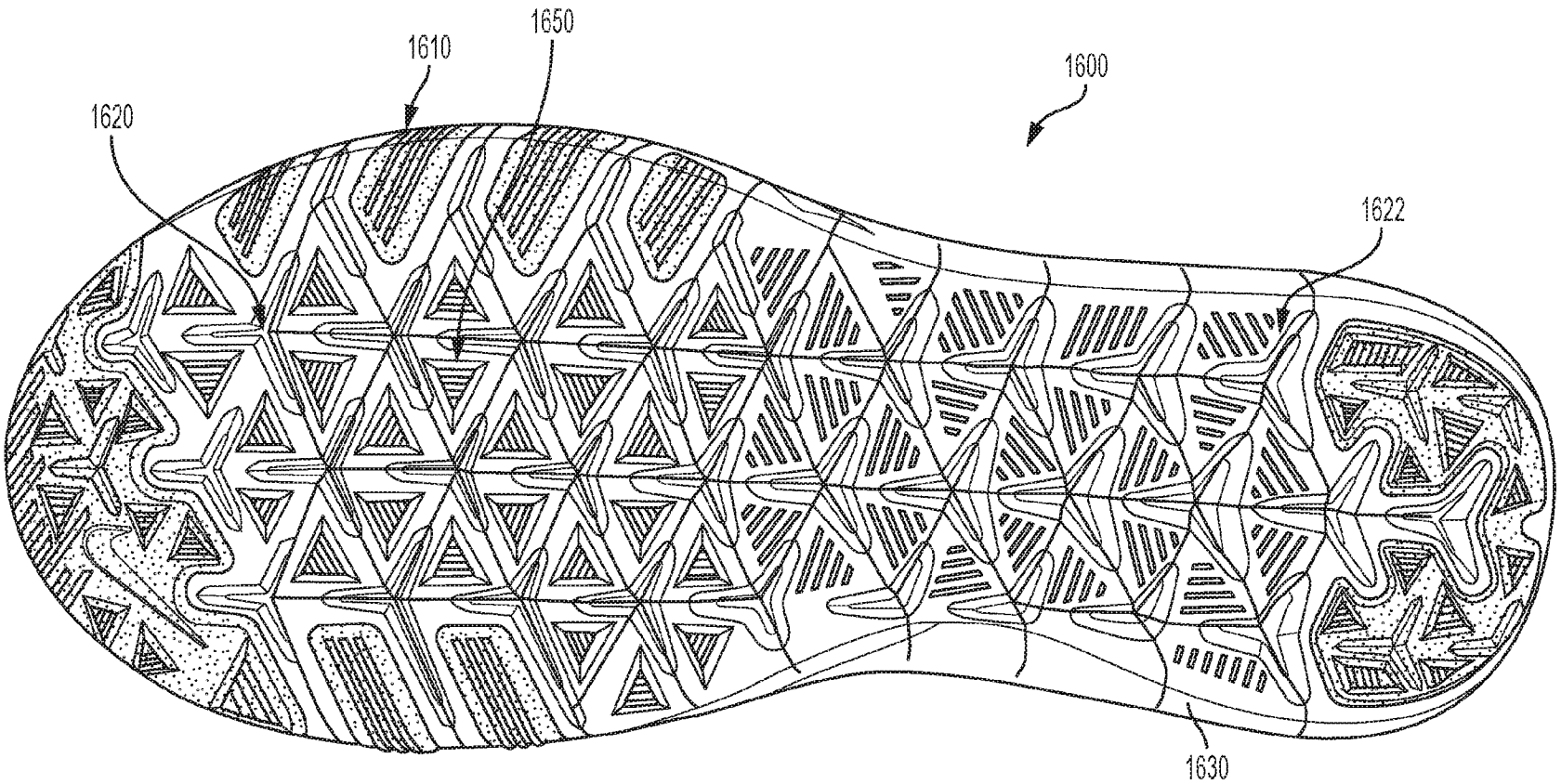
FIGS. 16-17 are schematic bottom views of an embodiment of a sole structure with auxetic openings and sipes.
Figure 17:
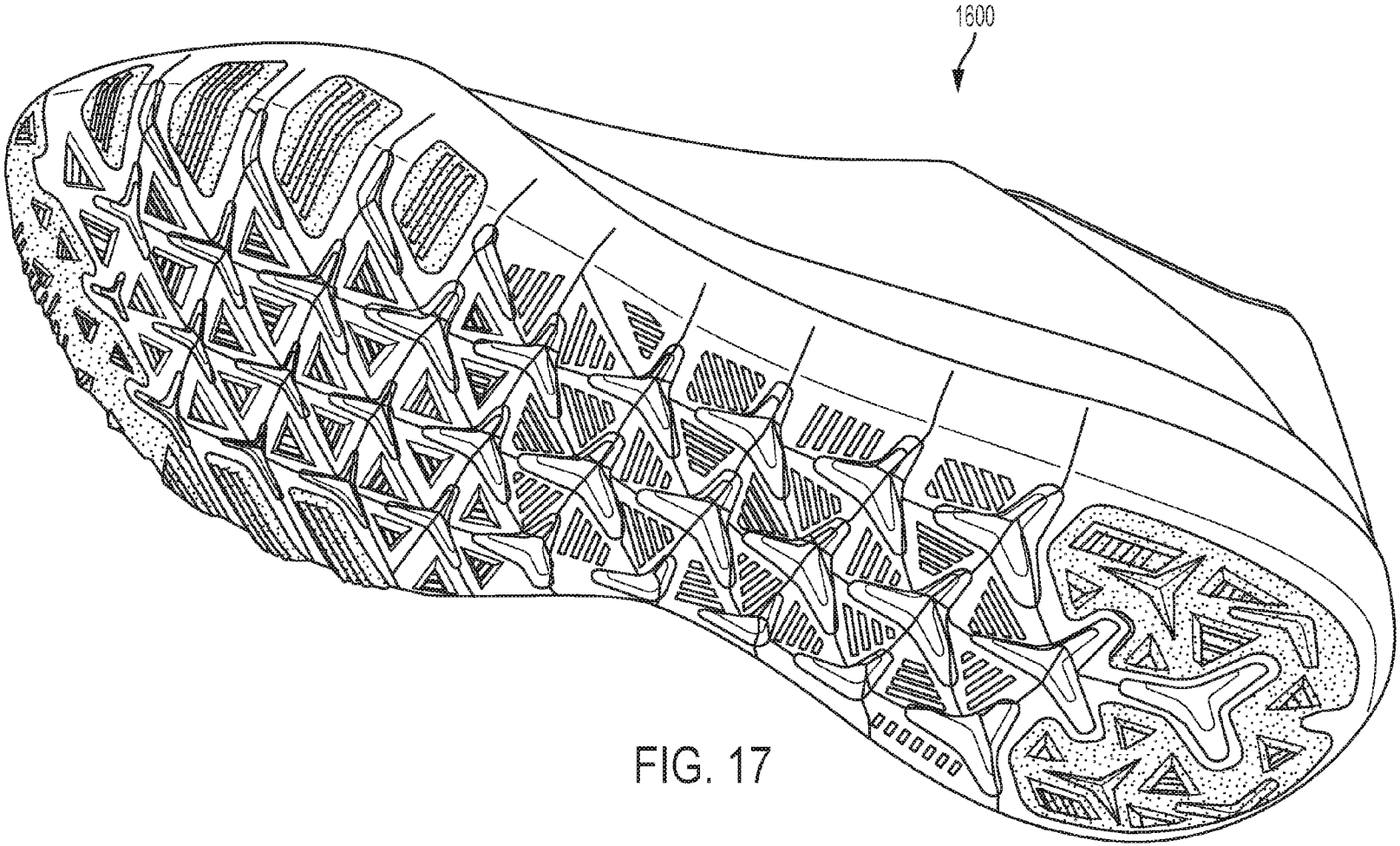

It may be appreciated that some embodiments can include raised treads or traction-like features that are integrally (or continuously) formed with the underling midsole or sole component that provides the majority of the volume of a sole structure. Thus, for example, sole structure 1600 of FIG. 16 is seen to include raised tread elements 1650 that extend from the underlying sole portions, which are themselves part of midsole component 1630. A similar construction is found in sole structure 1800 of FIG. 18, which includes similar raised tread elements 1850. It may be appreciated that these tread elements, though configured to facilitate traction, may be distinct from the use of distinct outer sole members (or pads) atop one or more sole portions, since outer sole members may be comprised of distinct materials from the underlying midsole and therefore may have different material properties (e.g., traction, density, durability, etc.).

As another example, sole structure 800 of FIG. 8 is seen to include a combination of separate outer sole members and raised tread elements within forefoot region 810. For example, outer sole members 870 are seen to alternate with a set of raised tread elements 890 (triangular in the embodiment).

The embodiments include a variety of different tread surfaces that can be used with outer sole members (and/or with surfaces of a midsole component). For example, FIG. 18 includes sole structure 1800 that includes raised ridge tread elements 1820 on portions of midsole component 1803 as well as on outer sole members (e.g., outer sole members 1810). In other embodiments, other kinds of tread features or surface features could be used. For example, in sole structure 800, outer sole members may be configured with bristle-like elements. As shown in FIG. 10, for example, outer sole member 895 includes bristle-like tread features 897. In still other embodiments, outer sole members may have flat or smooth surfaces and may rely on intrinsic material characteristics to provide enhanced grip and/or durability. Such examples can be seen in sole structure 100, sole structure 200, sole structure 1100 and sole structure 1400.

By varying the type, size, shape, location, surface features and/or material characteristics of outer sole members, the traction and durability properties of a sole structure can be varied. It may be appreciated that other embodiments could incorporate any combinations of the outer sole member features that have been described herein and/or shown in the figures.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A sole structure for an article of footwear, the sole structure having an outer perimeter and further comprising:

a first region and a second region, the first region being disposed adjacent to the second region;

a midsole component and one or more outsole members disposed on an outer surface of the midsole component, the midsole component including:

a first set of openings arranged in an auxetic configuration, the first set of openings being disposed in the first region;

a first set of sole portions bounding the first set of openings;

a set of sipes disposed in the second region, the set of sipes including a plurality of sipes that extend from the outer perimeter to at least one opening belonging to the first set of openings, the set of sipes dividing the second region into a second set of sole portions;

wherein every sole portion in the first set of sole portions is continuously connected to at least one other sole portion in the first set of sole portions by a junction; and wherein every sole portion in the second set of sole portions is separated from any adjacent sole portion by a sipe from the set of sipes; and wherein the first set of openings includes a plurality of openings, and wherein a portion of each opening of the plurality of openings is disposed between adjacent portions of the one or more outsole members.

2. The sole structure according to claim 1, wherein the sole structure includes a central region and a peripheral region surrounding the central region, and wherein the first region is in the central region.

3. The sole structure according to claim 2, wherein the first region is part of a forefoot region of the sole structure and wherein the second region is part of a midfoot region and a heel region of the sole structure.

4. The sole structure according to claim 1, wherein the first set of sole portions are configured to move in a coordinated manner to achieve auxetic expansion for the first region when tension is applied across the first region and wherein the second set of sole portions are configured to move independently of one another to facilitate flexibility for the second region when tension is applied across the second region.

5. The sole structure according to claim 1, wherein the first set of sole portions have a triangular cross-sectional geometry and wherein the second set of sole portions have a triangular cross-sectional geometry.

6. A sole structure for an article of footwear, the sole structure having an outer perimeter and further comprising:

a midsole component and an outer sole member disposed on an outer surface of the midsole component;

a set of openings arranged in an auxetic configuration in the midsole component, the set of openings including a first opening with a first arm portion, a second arm portion and a third arm portion extending from a central portion of the opening;

a set of sipes provided in the midsole component, each sipe extending from the outer perimeter to at least one opening belonging to the set of openings;

the outer sole member including a slotted region including a slot separating a first finger portion and a second finger portion of the outer sole member; and wherein the first arm portion of the first opening extends into the slot.

7. The sole structure according to claim 6, wherein the outer sole member is disposed in a toe region of the sole structure.

8. The sole structure according to claim 6, wherein the outer sole member comprises multiple slots and wherein the set of openings comprises multiple openings such that each of the multiple openings has an arm portion extending into a slot of the multiple slots.

9. The sole structure according to claim 6, wherein the outer sole member includes a treaded surface.

* * * * *